US011376851B2

(12) United States Patent
Takabe

(10) Patent No.: US 11,376,851 B2
(45) Date of Patent: Jul. 5, 2022

(54) LIQUID EJECTING HEAD AND LIQUID EJECTING APPARATUS

(71) Applicant: SEIKO EPSON CORPORATION, Tokyo (JP)

(72) Inventor: Motoki Takabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/980,188

(22) PCT Filed: Dec. 18, 2018

(86) PCT No.: PCT/JP2018/046603
§ 371 (c)(1),
(2) Date: Sep. 11, 2020

(87) PCT Pub. No.: WO2019/176211
PCT Pub. Date: Sep. 19, 2019

(65) Prior Publication Data

US 2021/0008882 A1 Jan. 14, 2021

(30) Foreign Application Priority Data

Mar. 13, 2018 (JP) ..... JP2018-045071
Oct. 23, 2018 (JP) ..... JP2018-199058

(51) Int. Cl.
*B41J 2/14* (2006.01)
*B41J 2/175* (2006.01)

(52) U.S. Cl.
CPC ..... *B41J 2/1433* (2013.01); *B41J 2/14201* (2013.01); *B41J 2/175* (2013.01); *B41J 2002/14419* (2013.01)

(58) Field of Classification Search
CPC ..... B41J 2/1433; B41J 2/175; B41J 2/14201; B41J 2002/14419; B41J 2002/14241; B41J 2/14233; B41J 2202/12; B41J 2002/14362
See application file for complete search history.

(56) References Cited

U.S. PATENT DOCUMENTS

2012/0176450 A1 7/2012 Akahane et al.
2015/0062255 A1 3/2015 Sasaki
(Continued)

FOREIGN PATENT DOCUMENTS

JP 2008149594 A 7/2008
JP 2012143948 A 8/2012
(Continued)

OTHER PUBLICATIONS

IP.com search (Year: 2021).*

*Primary Examiner* — Lisa Solomon
(74) *Attorney, Agent, or Firm* — Workman Nydegger

(57) ABSTRACT

A liquid ejecting head capable of suppressing an increase in size in a configuration in which a liquid circulates between the liquid ejecting head and a liquid storage portion and a liquid ejecting apparatus are provided. Pressures chambers communicating with nozzles that eject a liquid, a first common flow path through which the liquid is supplied to the pressure chambers side, a second common flow path through which the liquid is led out from the pressure chambers side, a first compliance portion that deforms in response to a pressure change in the liquid inside the first common flow path, and a second compliance portion that deforms in response to a pressure change in the liquid inside the second common flow path are provided. The first compliance portion and the second compliance portion overlap
(Continued)

each other when viewed in a thickness direction of at least one of the compliance portions.

19 Claims, 8 Drawing Sheets

(56) References Cited

U.S. PATENT DOCUMENTS

| | | | |
|---|---|---|---|
| 2015/0306875 | A1 | 10/2015 | Nishimura et al. |
| 2017/0217172 | A1 | 8/2017 | Naganuma et al. |
| 2017/0225485 | A1 | 8/2017 | Nakai |
| 2018/0304631 | A1 | 10/2018 | Kobayashi et al. |

FOREIGN PATENT DOCUMENTS

| | | | | |
|---|---|---|---|---|
| JP | 2015071289 | A | | 4/2015 |
| JP | 2017077643 | A | * | 4/2017 |
| JP | 2017077643 | A | | 4/2017 |
| JP | 2017513740 | A | | 6/2017 |
| JP | 2017132211 | A | | 8/2017 |
| JP | 2017132237 | A | | 8/2017 |
| JP | 2017140826 | A | | 8/2017 |
| JP | 2017209821 | A | | 11/2017 |
| WO | 2017002778 | A | | 1/2017 |

* cited by examiner

LIQUID EJECTING HEAD AND LIQUID EJECTING APPARATUS

TECHNICAL FIELD

The present disclosure relates to a liquid ejecting head such as an ink jet recording head, a liquid ejecting apparatus including the liquid ejecting head, and more particularly, a liquid ejecting head including a compliance portion that suppresses pressure oscillation of a liquid in a liquid flow path, and a liquid ejecting apparatus.

BACKGROUND ART

The liquid ejecting apparatus is an apparatus provided with a liquid ejecting head and ejects (discharges) various liquids from the liquid ejecting head. As the liquid ejecting apparatus, for example, there are image recording apparatuses such as an ink jet printer and an ink jet plotter, but recently, the liquid ejecting apparatus is also applied to various types of manufacturing apparatus, making use of the feature of being capable of accurately causing an extremely small amount of liquid land accurately on a predetermined position. For example, the liquid ejecting apparatus is applied to a display manufacturing apparatus that manufactures a color filter such as a liquid crystal display, an electrode forming apparatus that forms electrodes of an organic EL (Electro Luminescence) display, an FED (face emitting display), or the like, and a chip manufacturing apparatus that manufactures biochips (biochemical elements). A recording head for the image recording apparatus ejects liquid ink, and a color material ejecting head for the display manufacturing apparatus ejects solutions of each color material of R (Red), G (Green), and B (Blue). An electrode material ejecting head for the electrode forming apparatus ejects a liquid electrode material, and a bioorganic material ejecting head for the chip manufacturing apparatus ejects a bioorganic material solution.

As the above liquid ejecting head, there is a liquid ejecting head provided with a nozzle plate having a plurality of nozzles formed therein, a substrate having a plurality of pressure chambers (also referred to as pressure generating chambers) communicating with each nozzle, a substrate in which a common liquid chamber (also referred to as a reservoir or a manifold) shared by each of the pressure chambers into which a liquid is introduced from a liquid storage portion is formed, and a pressure generating means such as a piezoelectric element that generates pressure oscillation in the liquid inside the pressure chamber (for example, refer to PTL 1). A configuration is adopted in which the liquid ejecting head disclosed in PTL 1 is provided with a circulation flow path communicating between each pressure chamber and each nozzle and the liquid circulates between the liquid ejecting head and the liquid storage portion.

In the liquid ejecting head of such a configuration, a compliance portion is provided in which a portion of the flow path is provided with a flexible member that deforms in response to pressure changes in the liquid inside the flow path. The compliance portion deforms in response to the pressure oscillation inside the liquid chamber and absorbs the pressure oscillation generated in the liquid inside the liquid chamber.

CITATION LIST

Patent Literature

PTL 1: Japanese Unexamined Patent Application Publication No. 2012-143948

SUMMARY OF INVENTION

Technical Problem

Incidentally, in the above-described configuration in which the liquid circulates, it is desirable to dispose a compliance portion on each of an outward path from a liquid storage portion side toward a pressure chamber side and a return path from the pressure chamber side to the liquid storage portion side. However, there is a problem in that the size of the liquid ejecting head becomes large depending on the disposition layout of these compliance portions, which leads to an increase in the size of the liquid ejecting apparatus.

The present disclosure is made in view of these circumstances and an object thereof is to provide a liquid ejecting head capable of suppressing an increase in size in a configuration in which a liquid circulates between the liquid ejecting head and a liquid storage portion, and to provide a liquid ejecting apparatus.

Solution to Problem

A liquid ejecting head of the present disclosure is proposed in order to achieve the object described above and includes a plurality of pressure chambers communicating with a plurality of nozzles that eject a liquid, a first common flow path through which the liquid is supplied to the plurality of pressure chambers side, a second common flow path through which the liquid is led out from the plurality of pressure chambers side, a first compliance portion that deforms in response to a pressure change in the liquid inside the first common flow path, and a second compliance portion that deforms in response to a pressure change in the liquid inside the second common flow path, in which the first compliance portion and the second compliance portion overlap each other when viewed in a thickness direction of at least one of the compliance portions.

According to the liquid ejecting head of the present disclosure, since the first compliance portion and the second compliance portion overlap each other when viewed in the thickness direction of at least one of the compliance portions, even in the configuration in which the compliance portions are provided in each of the first common flow path configuring the outward path toward the pressure chamber side and the second common flow path through which the liquid is led out from the pressure chamber side, it is possible to suppress an increase in the size of the liquid ejecting head.

A liquid ejecting head of the present disclosure may include a plurality of pressure chambers communicating with a plurality of nozzles that eject a liquid, a first common flow path through which the liquid is supplied to the plurality of pressure chambers side, a second common flow path through which the liquid is led out from the plurality of pressure chambers side, a first compliance portion that deforms in response to a pressure change in the liquid inside the first common flow path, and a second compliance portion that deforms in response to a pressure change in the liquid inside the second common flow path, in which the first compliance portion and the second compliance portion may overlap each other in a thickness direction of a nozzle plate provided with the nozzles.

According to this configuration, since the first compliance portion and the second compliance portion overlap in the thickness direction of the nozzle plate provided with the nozzles, even in the configuration in which the compliance portions are provided in each of the first common flow path configuring the outward path toward the pressure chamber side and the second common flow path through which the liquid is led out from the pressure chamber side, it is possible to suppress an increase in the size of the liquid ejecting head.

Since the plurality of pressure chambers, in other words, the first common flow path and the second common flow path shared by the plurality of nozzles are each provided with the compliance portions, as compared to a configuration in which the individual flow paths provided to individually correspond to the plurality of pressure chambers are each provided with the compliance portions, it is possible to more efficiently suppress the pressure oscillation generated in accordance with the liquid ejection operation in each of the pressure chambers. Therefore, even when ink is ejected from each of the nozzles at a higher drive frequency, since it is possible to more reliably suppress the pressure oscillations generated in accordance with the ejection operation, it is possible to handle the liquid ejection at a higher drive frequency.

In the above configuration, it is desirable to adopt a configuration in which a compliance of the second compliance portion is larger than a compliance of the first compliance portion.

According to this configuration, due to the compliance of the second compliance portion being larger than the compliance of the first compliance portion, for example, even when the pressure oscillation during the driving of the circulation mechanism that circulates the liquid between the liquid storage portion storing the liquid and the liquid ejecting head is superimposed on the pressure oscillation during the ejecting of the liquid from the nozzles, it is possible to reduce the pressure oscillation using the second compliance portion, and fluctuation of the ejection characteristics of the liquid from the nozzles caused by the pressure oscillation, that is, fluctuation of the amount and flight speed of the ejected liquid from target values is suppressed.

In the above configuration, it is desirable to adopt a configuration in which, a compliance of one of the first compliance portion and the second compliance portion that is closer to the nozzles is larger than a compliance of the other that is farther from the nozzles.

According to this configuration, of the first compliance portion or the second compliance portion, the compliance of the one closer to the nozzles is larger than the compliance of the one farther from the nozzles, so that it is possible to more reliably reduce the pressure oscillation generated by the ejection of the liquid from the nozzles at a position closer to the nozzles. Fluctuation in the ejection characteristics of the liquid from the nozzles, that is, fluctuation in the amount and the flight speed of the ejected liquid from the target values is further suppressed.

In the above configuration, it is desirable to adopt a configuration including a plurality of individual outlet flow paths that individually allows communication from the pressure chambers to the second common flow path, in which the second compliance portion does not overlap the plurality of individual outlet flow paths when viewed in a thickness direction of the second compliance portion.

According to this configuration, since the second compliance portion does not overlap the individual outlet flow paths when viewed in the thickness direction of the second compliance portion, that is, since the partition walls partitioning the individual outlet flow paths do not interfere with the second compliance portion, when the second compliance portion is deformed, stress being focused on a portion in contact with the partition walls partitioning the individual outlet flow paths and the second compliance portion being damaged originating at the portion, variation in the flow path resistance in each of the individual outlet flow paths, and the like are prevented.

In the above configuration, it is desirable to adopt a configuration in which, when an inner dimension of the individual outlet flow paths in a flow path arrangement direction of the plurality of individual outlet flow paths is denoted by W, in a flow path extending direction of the individual outlet flow path, an edge of a displaceable flexible region of the second compliance portion in the second common flow path that is closest to the individual outlet flow path is disposed within W from an exit of the individual outlet flow path on the second common flow path side.

According to this configuration, due to the edge of the flexible region of the second compliance portion that is closest to the individual outlet flow paths being disposed within is a distance corresponding to the inner dimension of the individual outlet flow paths from the exits of the individual outlet flow paths on the second common flow path side, the pressure oscillation transmitted through the inner portion of the individual outlet flow paths are alleviated more quickly. Accordingly, variations in the ejection characteristics of each of the nozzles are suppressed more effectively.

In the above configuration, it is desirable to adopt a configuration in which a plurality of individual supply flow paths that individually allow communication from the first common flow path to the plurality of pressure chambers, in which the first compliance portion does not overlap the plurality of individual supply flow paths when viewed in a thickness direction of the first compliance portion.

According to this configuration, since the first compliance portion does not overlap the individual supply flow paths when viewed in the thickness direction of the first compliance portion, that is, since the partition walls partitioning the individual supply flow paths do not interfere with the first compliance portion, when the first compliance portion is deformed, stress being focused on a portion in contact with the partition walls partitioning the individual supply flow paths and the first compliance portion being damaged originating at the portion, variation in the flow path resistance in each of the individual supply flow paths, and the like are prevented.

Further, in the above configuration, it is desirable to adopt a configuration in which a thickness of one of a first partition wall separating the plurality of individual supply flow paths or a second partition wall separating the plurality of individual outlet flow paths is thicker than a thickness of the other in the flow path arrangement direction, and a length of the one is longer than a length of the other in the flow path extending direction.

According to this configuration, when the constituent members of the liquid ejecting head are bonded in a state of being laminated to each other, even if the relative positions of the constituent members are slightly deviated from each other, since the one of the first partition wall or the second partition wall fits within the range of the other when viewed from the laminating direction of the constituent members, it is possible to receive the load during the bonding on the partition walls, and it is possible to more reliably bond each of the constituent members, particularly the members in which the individual supply flow paths are formed and the members in which the individual outlet flow paths are formed.

In the above configuration, it is desirable to adopt a configuration in which a position of an exit of the individual outlet flow paths on the second common flow path side in the flow path extending direction positioned closer to end sides in the flow path arrangement direction of the plurality of individual outlet flow paths and a position of an exit of the individual outlet flow paths on the second common flow path side positioned closer to a center side in the flow path arrangement direction are different.

According to this configuration, even when there is a difference in the structure of the walls partitioning the individual outlet flow paths positioned on the end portion sides in the flow path arrangement direction and the individual outlet flow paths positioned closer to the center side, respectively, since the positions of the exits of the individual outlet flow paths positioned closer to the end sides in the flow path arrangement direction and the positions of the exits of the individual outlet flow paths positioned closer to the center side in the flow path arrangement direction are different, the flow path resistance of each of the individual outlet flow paths is aligned. As a result, the ejection characteristics such as the ejected ink amount of each nozzle corresponding to each individual outlet flow path and the flight speed are aligned as much as possible.

In the above configuration, it is desirable to adopt a configuration in which two nozzle groups formed by arranging the nozzles are arranged in a direction perpendicular to an arrangement direction of the nozzles, two first common flow paths forming a pair are disposed between two second common flow paths forming a pair in the arrangement direction of the nozzle groups, and the nozzle groups are disposed between the two first common flow paths.

According to this configuration, the pair of first common flow paths is disposed between the pair of second common flow paths in the arrangement direction of the nozzle groups and the nozzle groups are disposed between the first common flow paths, and so it is possible to dispose the nozzle groups at a higher density and it is possible to more efficiently better layout the liquid flow paths and the like including the common flow paths corresponding to each of the nozzle groups and the pressure chambers in the inner portion of the liquid ejecting head.

The liquid ejecting apparatus according to the present disclosure includes the liquid ejecting head of one of the configurations described above, a liquid storage portion storing a liquid to be supplied to the liquid ejecting head, and a circulation mechanism for circulating the liquid between the liquid storage portion and the liquid ejecting head.

According to the present disclosure, in a configuration in which a liquid is circulated between a liquid storage portion and a liquid ejecting head, since it is possible to reduce the size of the liquid ejecting head, it is possible to reduce the size of the entire apparatus.

DESCRIPTION OF EMBODIMENTS

Hereinafter, embodiments of the present disclosure will be described with reference to the accompanying drawings. In the embodiments described hereinafter, although various limitations are made as favorable specific examples of the present disclosure, the scope of the present disclosure is not limited to these modes as long as there is no description particularly limiting the present disclosure. The following description will be carried out using an ink jet recording apparatus (hereinafter, a printer) 1 equipped with an ink jet recording head (hereinafter, a recording head) 10 which is a type of liquid ejecting head as an example of the liquid ejecting apparatus of the present disclosure.

Figure 1:
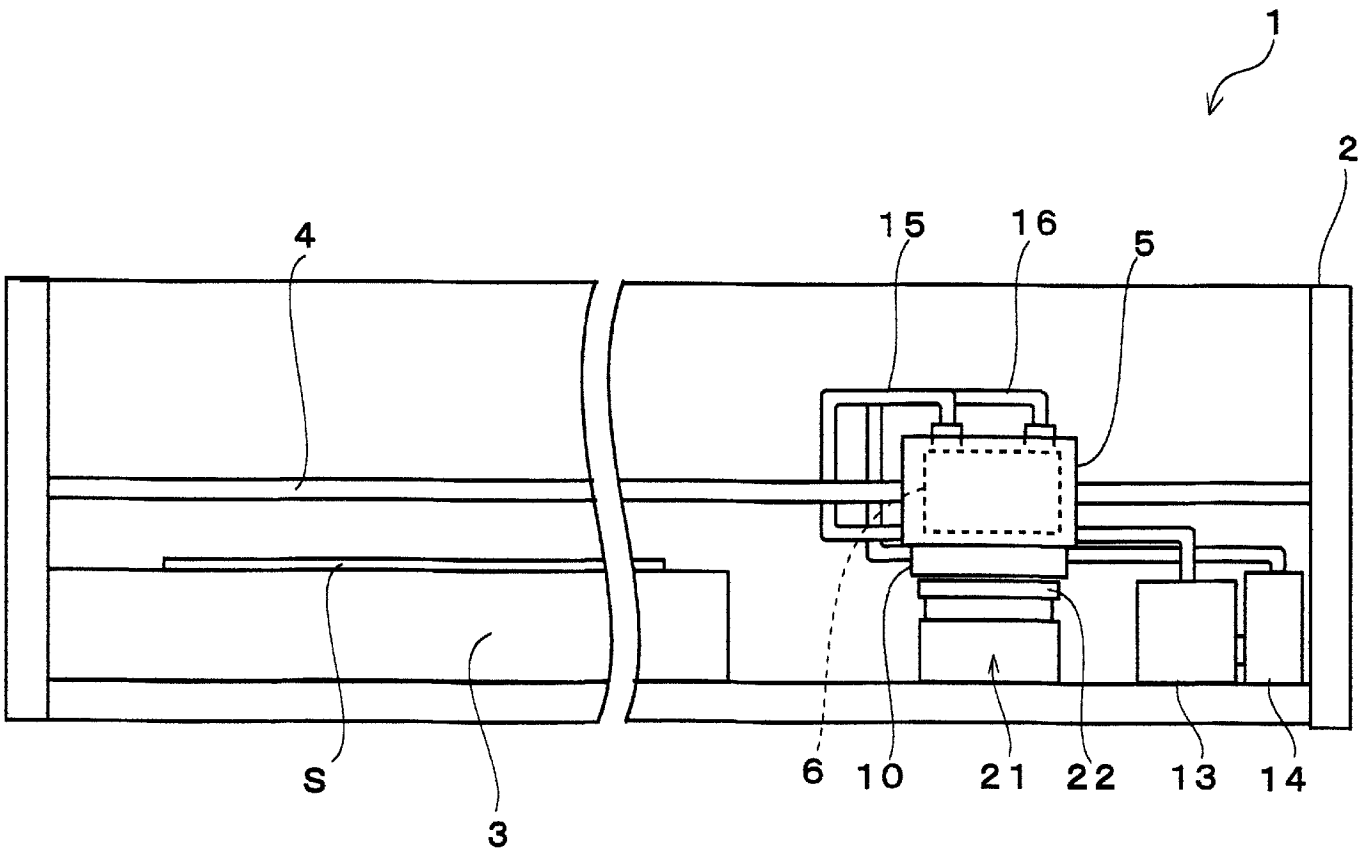
FIG. 1 is a front view explaining the configuration of an embodiment of a liquid ejecting apparatus.

FIG. 1 is a plan view illustrating the configuration of the printer 1. The printer 1 according to the present embodiment is an apparatus which performs recording of an image, text, or the like by ejecting liquid ink (a type of liquid in the present disclosure) from the recording head 10 onto the surface of a recording medium S such as recording paper, cloth, or resin film. The printer 1 is provided with a frame 2 and a platen 3 disposed inside the frame 2 and the recording medium S is transported onto the platen 3 by a transport mechanism (not illustrated). A guide rod 4 is installed in parallel with the platen 3 inside the frame 2. The recording head 10 and a carriage 5 accommodating a flow path member 6 are supported to be capable of sliding on the guide rod 4. The flow path member 6 performs transferring of ink between the recording head 10 and an ink cartridge 13. The carriage 5 is configured to move reciprocally along the guide rod 4 in a main scanning direction perpendicular to a transport direction of the recording medium S. The printer 1 in the present embodiment performs a recording operation by ejecting ink from nozzles 28 (refer to FIG. 2 and the like) of the recording head 10 while moving the carriage 5 reciprocally relative to the recording medium S.

The ink cartridge 13, which is a type of liquid storage portion, is equipped on one side of the frame 2. The ink stored in the ink cartridge 13 is introduced into the flow path member 6 through an ink supply tube 15 by the pressure of a pump 14 and is subsequently supplied to the recording head 10. The ink from the recording head 10 is configured to be recovered in the ink cartridge 13 through the flow path member 6 and an ink recovery tube 16. In other words, the pump 14 functions as a circulation mechanism that circulates the ink between the ink cartridge 13 and the recording head 10. Although not illustrated, an inner portion of the flow path member 6 is provided with a flow path which supplies the ink introduced from the ink supply tube 15 to the recording head 10 side and a flow path which sends the ink discharged from the recording head 10 out to the ink recovery tube 16. The inner portion of the flow path member 6 is provided with an adjusting section which adjusts the supply pressure of the ink to the recording head 10, a filter (not illustrated) which traps bubbles and foreign matter contained in the ink, and the like. Instead of the configuration in which the circulation of ink is performed between the ink cartridge 13 and the recording head 10 as described above, a configuration may be adopted in which a sub-tank (that is, a type of liquid storage portion) that is not illustrated is provided between the ink cartridge 13 and the recording head 10 and the circulation of the ink is performed between the sub-tank and the recording head 10.

Inside the frame 2, a capping mechanism 21 including a cap 22 sealing the nozzle surface of the recording head 10 is installed at a home position provided on one side in a movement range of the recording head 10. The capping mechanism 21 seals the nozzle surface of the recording head 10 in the standby state at the home position using the cap 22 to suppress the evaporating of the solvent of the ink from the nozzle 28. The capping mechanism 21 is capable of performing a cleaning operation of making the inside of the sealing space portion a negative pressure in a state in which the nozzle surface of the recording head 10 is sealed and forcibly sucking ink and bubbles from the nozzles 28.

Next, the configuration of the recording head 10 in the present embodiment will be described.

Figure 2:
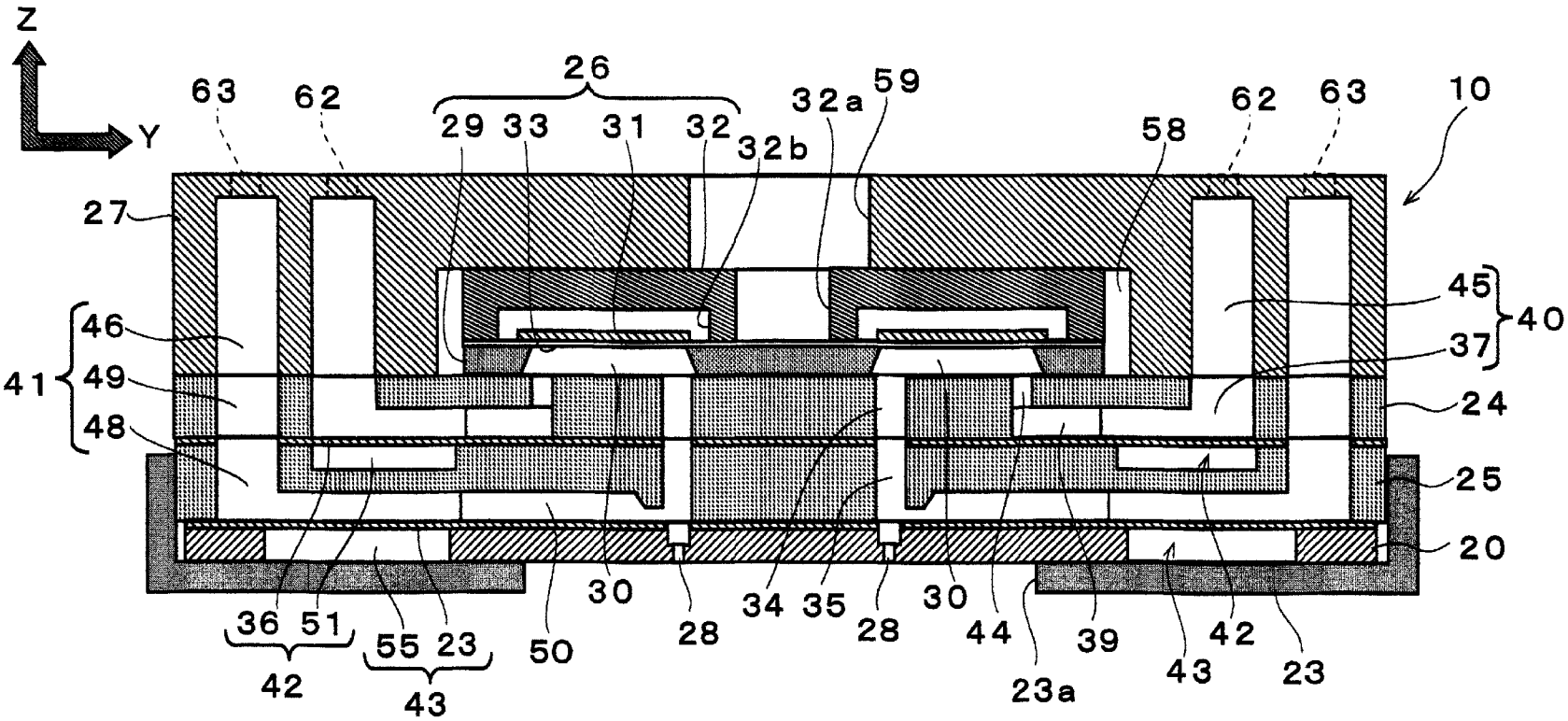
FIG. 2 is a sectional diagram explaining the configuration of an embodiment of a liquid ejecting head.
Figure 3:
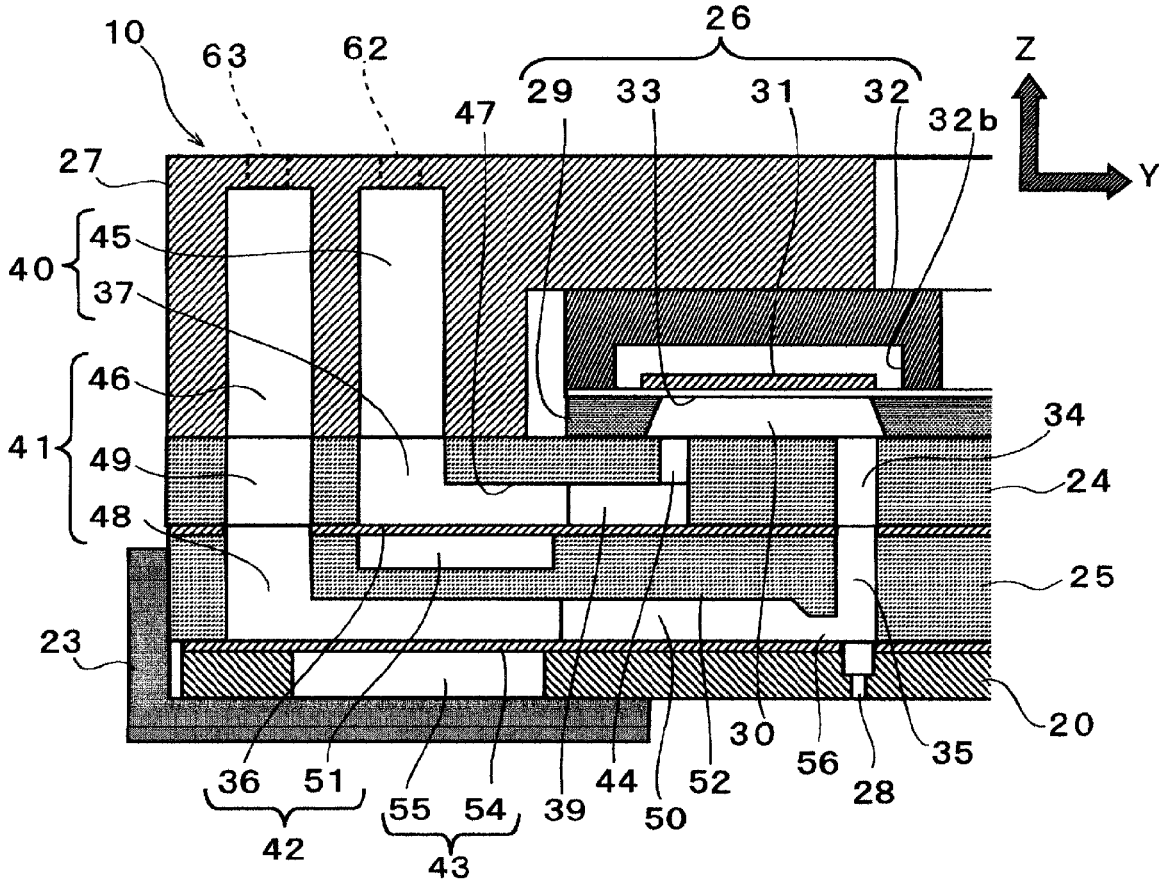
FIG. 3 is an enlarged sectional diagram of a portion of the liquid ejecting head.

FIG. 2 is a sectional diagram of the recording head 10, and FIG. 3 is an enlarged sectional diagram illustrating a portion of the recording head 10 in FIG. 2. In the recording head 10 according to the present embodiment, a plurality of constituent members such as a fixed plate 23, a nozzle plate 20, a first communication plate 24, a second communication plate 25, an actuator substrate 26, and a case 27 are laminated and bonded by an adhesive or the like to unitize the constituent members. Hereinafter, the laminating direction of each of the constituent members of the recording head 10 will be described as the vertical direction or a third direction Z as described later, as appropriate.

The actuator substrate 26 in the present embodiment is provided with a pressure chamber forming substrate 29 in which pressure chambers 30 communicating with the nozzles 28 formed in the nozzle plate 20 are formed, piezoelectric elements 31 serving as drive elements that generate pressure oscillation in the ink inside each of the pressure chambers 30, oscillating plates 33 provided between the pressure chamber forming substrate 29 and the piezoelectric elements 31, and a protective substrate 32 protecting the piezoelectric elements 31. A wiring space portion 32*a*, through which a wiring member electrically coupled to the piezoelectric elements 31 is inserted, is provided at a substantially central portion of the protective substrate 32 in plan view. Lead electrodes of the piezoelectric elements 31 are disposed inside the wiring space portion 32*a* and wiring terminals of the wiring member are electrically coupled to the lead electrodes. Drive signals and the like sent from a control section of the printer 1 are supplied to the piezoelectric elements 31 through the wiring member.

The pressure chamber forming substrate 29 of the actuator substrate 26 is made of a silicon single crystal substrate. The plurality of pressure chambers 30 is arranged in the pressure chamber forming substrate 29 along a first direction X (in other words, a nozzle row direction) in which each of the nozzles 28 are arranged corresponding to the plurality of nozzles 28. The pressure chamber 30 is a vacant portion that is long in a second direction Y perpendicular to the first direction X. A first nozzle communication port 34 of the first communication plate 24 communicates with an end portion on one side of the pressure chamber 30 in the second direction Y and the individual supply flow path 39 communicates with an end portion on the other side of the pressure chamber 30 via a supply port 44. On the pressure chamber forming substrate 29 in the present embodiment, a total of two rows of pressure chamber groups, which are the rows of the pressure chambers 30, are arranged in the second direction Y corresponding to the two nozzle rows formed in the nozzle plate 20. The pressure chamber forming substrate 29 may be made of a metal such as stainless steel.

The oscillating plate 33 is laminated on the top surface of the pressure chamber forming substrate 29 (in other words, the surface on the opposite side to the first communication plate 24 side) and the top portion opening of the pressure chamber 30 is sealed by the oscillating plate 33. In other words, the oscillating plate 33 partitions a portion of the pressure chamber 30. The oscillating plate 33 includes, for example, an elastic film formed of silicon dioxide ($SiO_2$) formed on the top surface of the pressure chamber forming substrate 29 and an insulator film formed of zirconium oxide ($ZrO_2$) formed on the elastic film. The piezoelectric elements 31 is laminated on the oscillating plate 33 in regions corresponding to the pressure chambers 30, respectively. The oscillating plate 33 may be made of a metal such as nickel.

The piezoelectric element 31 of the present embodiment is a so-called flexural mode piezoelectric element. In the piezoelectric element 31, for example, a bottom electrode layer, a piezoelectric layer, and a top electrode layer (none of which are illustrated) are sequentially laminated on the oscillating plate 33. The piezoelectric element 31 configured in this manner is deformed in a flexural manner in the vertical direction when an electric field is applied across the bottom electrode layer and the top electrode layer according to the potential difference between the two electrodes. In the present embodiment, the plurality of piezoelectric elements 31 is formed on the oscillating plates 33 to correspond to the plurality of pressure chambers 30 and a total of two rows of the piezoelectric elements 31 are provided to correspond to each of the rows of pressure chambers 30.

The protective substrate 32 is laminated on the oscillating plates 33 to cover the rows of the plurality of piezoelectric elements 31. In the inner portion of the protective substrate 32, a long accommodation space 32*b* capable of accommodating a row of the piezoelectric elements 31 is formed. The accommodation space 32*b* is a recess formed from the bottom surface side (that is, the oscillating plate 33 side) of the protective substrate 32 toward the top surface side (that is, the case 27 side) to the middle in the height direction of the protective substrate 32. In the protective substrate 32 in the present embodiment, the accommodation space 32*b* is formed on both sides of the wiring space portion 32*a*.

The first communication plate 24 having a wider area than the actuator substrate 26 is bonded to the bottom surface of the actuator substrate 26. The second communication plate 25 is bonded to the bottom surface of the first communication plate 24 with a first flexible portion 36, which will be described later, interposed therebetween. The communication plates 24 and 25 are made of a silicon single crystal substrate similar to that of the pressure chamber forming substrate 29. The first nozzle communication ports 34 causing the pressure chambers 30 and second nozzle communication ports 35 of the second communication plate 25 to communicate, a common liquid chamber 37 configuring a portion of a first common flow path 40 provided to be shared by each of the pressure chambers 30, the individual supply flow paths 39 causing the common liquid chamber 37 and the pressure chamber 30 to communicate, a communication liquid chamber 49 causing the common outlet liquid chamber 48 of the second communication plate 25 and an outlet flow path 46 of the case 27 to communicate are formed in the first communication plate 24 in the present embodiment. The communication liquid chamber 49 is a liquid chamber including an opening having a shape and dimensions conforming to the opening shape on the bottom surface side of the outlet flow path 46 of the case 27 and penetrates the first communication plate 24 in the plate thickness direction. The common liquid chamber 37 is a liquid chamber provided to be shared by the plurality of pressure chambers 30, in other words, the plurality of nozzles 28 and extends in series along the nozzle row direction. In the present embodiment, two common liquid chambers 37 are formed corresponding to each nozzle row of the nozzle plate 20. A first compliance portion 42 is provided at a position corresponding to the bottom portion of the common liquid chamber 37. The details of the first compliance portion 42 will be described later. The communication plates 24 and 25 may be made of a metal such as stainless steel.

Figure 4:
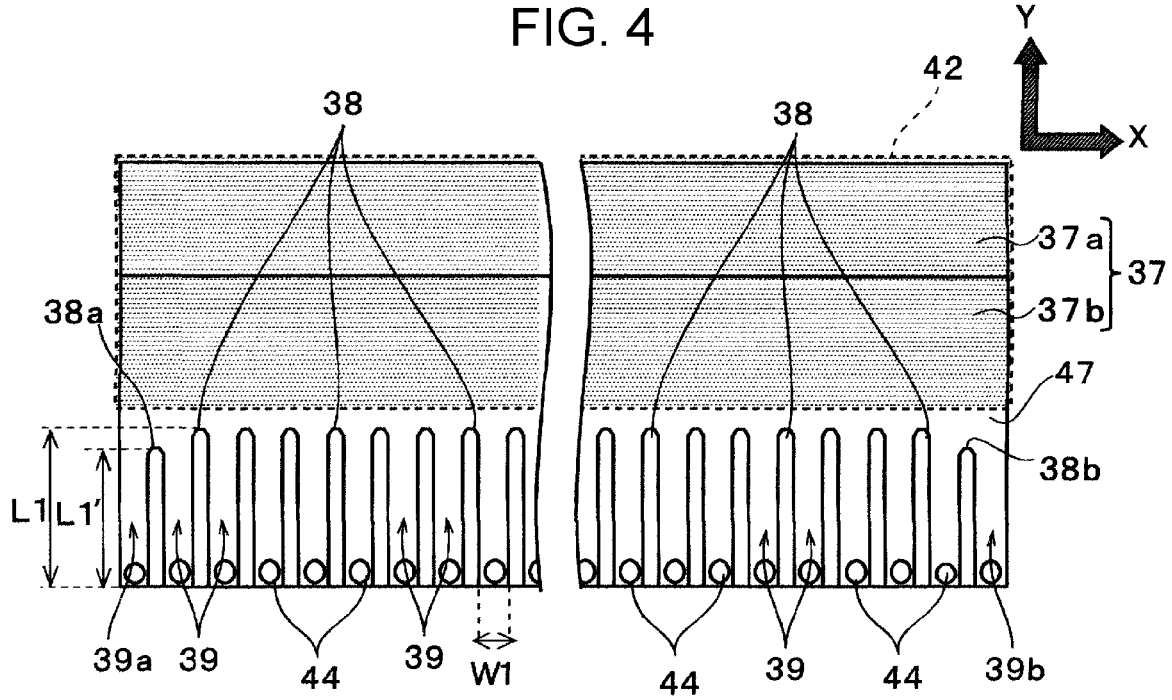
FIG. 4 is a plan view explaining the configuration of a common liquid chamber.

FIG. 4 is a plan view explaining the configuration of the common liquid chamber 37. The hatched portion indicates the range of the first compliance portion 42 described later. The common liquid chamber 37 in the present embodiment is configured from a first liquid chamber 37*a* communicating with an inlet flow path 45 of the case 27 and a second liquid chamber 37*b* causing the first liquid chamber 37*a* and the supply port 44 to communicate. The first liquid chamber 37*a* is a liquid chamber including an opening having a shape and dimensions conforming to the opening shape on the bottom surface side of the inlet flow path 45 of the case 27 and penetrates the first communication plate 24 in the plate thickness direction. The second liquid chamber 37*b* is a portion that is recessed from the bottom surface side to the middle in the plate thickness direction while leaving a thin portion 47 on the top surface side of the first communication plate 24. The second liquid chamber 37*b* is formed adjacent to the first liquid chamber 37*a* in the second direction Y. The second liquid chamber 37*b* is positioned closer to the nozzle 28 side than the first liquid chamber 37*a*. The thin portion 47 configures the ceiling surface of the second liquid chamber 37*b*. One end portion of the second liquid chamber 37*b* in the second direction Y communicates with the first liquid chamber 37*a*, and on the other hand, the other end portion of the second liquid chamber 37*b* in the second direction Y is formed at a position overlapping with a portion of the pressure chamber 30 when viewed in the third direction Z which is the laminating direction of each of the constituent members of the recording head 10. In the other end portion of the second liquid chamber 37*b*, a plurality of supply ports 44 penetrating the thin portion 47 are formed along the first direction X corresponding to each of the plurality of pressure chambers 30 of the pressure chamber forming substrate 29. The bottom end of the supply port 44 communicates with the second liquid chamber 37*b* and the top end of the supply port 44 communicates with the pressure chamber 30 of the pressure chamber forming substrate 29.

A plurality of supply port partition walls 38 (corresponding to the first partition wall in the present disclosure) partitioning the adjacent supply ports 44 from each other are formed in the thin portion 47 of the second liquid chamber 37*b* in the present embodiment. The supply port partition wall 38 is a wall extending along the second direction Y from the side surface of the other end of the second liquid chamber 37*b* in the second direction Y toward the first liquid chamber 37*a* side at one end and protrudes from the bottom surface of the thin portion 47 toward the second communication plate 25 side. The height of the supply port partition wall 38 in the third direction Z in the present embodiment is aligned to the depth of the second liquid chamber 37*b* in the third direction Z. The second communication plate 24 is bonded to the surface of the supply port partition wall 38 on the second communication plate 24 side via the first flexible portion 36, so that the individual supply flow path 39 extending along the second direction Y toward the supply port 44 from the first liquid chamber 37*a* side is defined. A plurality of the individual supply flow paths 39 is formed along the first direction X corresponding respectively to the plurality of pressure chambers 30 of the pressure chamber forming substrate 29. The supply port 44 described above is a portion where the flow path sectional area is set to be small as compared to that of the individual supply flow path 39 and functions as a narrowed portion imparting flow path resistance on the ink flowing from the common liquid chamber 37 into the pressure chamber 30.

Here, of the individual supply flow paths 39, regarding individual supply flow paths 39*a* and 39*b* positioned at both ends of the second liquid chamber 37*b* in the second direction Y (that is, the flow path arrangement direction), one wall of the walls partitioning the flow path is the supply port partition wall 38, whereas the other wall is a side wall partitioning the common liquid chamber 37. Since the dimension of the side wall of the common liquid chamber 37 in the flow path extending direction, that is, the second direction Y is sufficiently longer than the length of the supply port partition wall 38 in the second direction Y, when the lengths of the supply port partition walls 38 are uniformly aligned for all of the individual supply flow paths 39, the flow path resistances of the individual supply flow paths 39*a* and 39*b* at both ends are high as compared to the flow path resistances of the other individual supply flow paths 39. In other words, due to the difference in structure of the walls partitioning the individual supply flow paths 39*a* and 39*b* positioned on the end portion side in the flow path arrangement direction and the individual supply flow path 39 positioned closer to the center side, the flow path resistance changes.

Therefore, in the present embodiment, a length L1' of the supply port partition walls 38*a* and 38*b* that define the individual supply flow paths 39*a* and 39*b* at both ends is set to be shorter than a length L1 of the supply port partition walls 38 that define the other individual supply flow paths 39 positioned closer to the center side in the first direction X. In other words, in the second direction Y, the exits of the individual supply flow paths 39*a* and 39*b* on the first common flow path 40 side are positioned closer to the supply port 44 side than the exits of the other individual supply flow paths 39 on the first common flow path 40 side.

The exit of each individual supply flow path 39 on the first common flow path 40 side is an opening of the individual supply flow path 39 defined by the end of the supply port partition wall 38 partitioning the individual supply flow path 39 on the first common flow path 40 side. In this manner, even when there is a difference in the structure of the walls partitioning the individual supply flow paths 39 positioned on the end portion sides in the first direction X and the individual supply flow paths 39 positioned closer to the center side, respectively, since the positions of the exits of the individual supply flow paths 39*a* and 39*b* positioned closer to the end sides and the positions of the exits of the individual supply flow paths 39 positioned closer to the center side are different, the flow path resistance of each of the individual supply flow paths 39 is aligned as much as possible. As a result, the ejection characteristics such as the amount of ink ejected from each nozzle 28 in the nozzle row and the flight speed (more specifically, the initial velocity during ejection) are aligned as much as possible. In the present embodiment, although an example is given of a configuration in which the lengths of the supply port partition walls 38*a* and 38*b* defining the individual supply flow paths 39*a* and 39*b* at both ends in the first direction X are set to be shorter than the lengths of the supply port partition walls 38 of the other individual supply flow paths 39, the configuration is not limited thereto. For example, it is also possible to adopt a configuration in which the lengths of the supply port partition walls 38 corresponding to the plurality of individual supply flow paths 39 at both end portions in the first direction X is gradually reduced from the center side toward the end side in the first direction X. Accordingly, the flow path resistance of each of the individual supply flow paths 39 is more effectively aligned.

The second nozzle communication port 35 causing the first nozzle communication port 34 and the nozzle 28 to communicate with each other, the common outlet liquid chamber 48 configuring a portion of the second common flow path 41 provided to be shared by each of the pressure chambers 30, an individual outlet flow path 50 causing the common outlet liquid chamber 48 and the second nozzle communication port 35 to communicate with each other, and a first compliance space 51 configuring the first compliance portion 42 are formed in the second communication plate 25 in the present embodiment. The common outlet liquid chamber 48 is a liquid chamber provided to be shared by the plurality of pressure chambers 30, in other words, the plurality of nozzles 28 and extends in series along the first direction X. In the present embodiment, two common outlet liquid chambers 48 are formed corresponding to each nozzle row of the nozzle plate 20. A second compliance portion 43 is provided on the bottom portion of the common liquid chamber 37, that is, on the nozzle plate 20 side. The details of the second compliance portion 43 will be described later.

Figure 5:
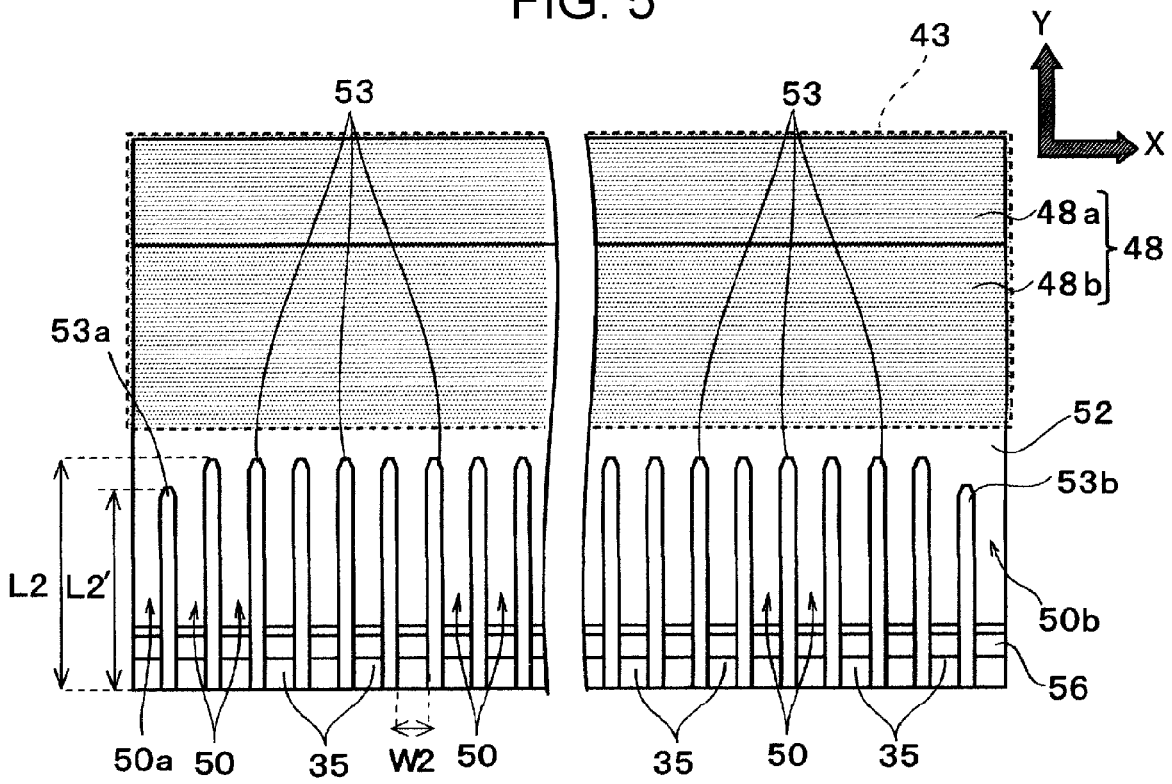
FIG. 5 is a plan view explaining the configuration of a common outlet liquid chamber.

FIG. 5 is a plan view explaining the configuration of the common outlet liquid chamber 48. The hatched portion indicates the range of the second compliance portion 43 described later. The common outlet liquid chamber 48 in the present embodiment is configured by a first outlet liquid chamber 48*a* communicating with the communication liquid chamber 49 of the first communication plate 24 and a second outlet liquid chamber 48*b* causing the first outlet liquid chamber 48*a* and the second nozzle communication port 35 to communicate with each other. The first outlet liquid chamber 48*a* is a liquid chamber including an opening having a shape and dimension conforming to the opening shape on the bottom surface side of the communication liquid chamber 49 of the first communication plate 24 and is a portion penetrating the second communication plate 25 in the plate thickness direction. The second outlet liquid chamber 48*b* is a portion that is recessed from the bottom surface side to the middle in the plate thickness direction while leaving a thin portion 52 on the top surface side of the second communication plate 25. The second outlet liquid chamber 48*b* is formed adjacent to the first outlet liquid chamber 48*a* in the second direction Y. The second outlet liquid chamber 48*b* is positioned closer to the nozzle 28 side than the first outlet liquid chamber 48*a*. The thin portion 52 configures the ceiling surface of the second outlet liquid chamber 48*b*. One end portion of the second outlet liquid chamber 48*b* in the second direction Y communicates with the first outlet liquid chamber 48*a*, whereas the other end portion of the second outlet liquid chamber 48*b* in the second direction Y is formed at a position corresponding to the first nozzle communication port 34 of the first communication plate 24. At the other end portion of the second outlet liquid chamber 48*b*, a plurality of the second nozzle communication ports 35 penetrating the second communication plate 25 in the thickness direction is formed along the first direction X corresponding to the plurality of pressure chambers 30 of the pressure chamber forming substrate 29, respectively. The bottom end of the second nozzle communication port 35 communicates with the nozzle 28 and the top end of the second nozzle communication port 35 communicates with the first nozzle communication port 34 of the first communication plate 24.

A plurality of outlet flow path partition walls 53 (corresponding to the second partition walls in the present disclosure) partitioning adjacent second nozzle communication ports 35 from each other is formed in the thin portion 52 of the second outlet liquid chamber 48*b*. The outlet flow path partition wall 53 is a wall extending along the second direction Y from the side surface of the other end of the second outlet liquid chamber 48*b* in the second direction Y toward the first outlet liquid chamber 48*a* side at one end and protrudes from the bottom surface of the thin portion 52 toward the bottom surface side of the second communication plate 25, in other words, toward the nozzle plate 20 side. The height of the outlet flow path partition wall 53 in the third direction Z in the present embodiment is aligned with the depth of the second outlet liquid chamber 48*b* in the third direction Z. The nozzle plate 20 is bonded to the surface of the outlet flow path partition wall 53 on the nozzle plate 20 side via a second flexible portion 54, so that the individual outlet flow path 50 extending along the second direction Y from the second nozzle communication port 35 side toward the first outlet liquid chamber 48*a* side is defined. A plurality of the individual outlet flow paths 50 is formed along the first direction X corresponding respectively to the plurality of pressure chambers 30 of the pressure chamber forming substrate 29.

Of the individual outlet flow paths 50, individual outlet flow paths 50*a* and 50*b* positioned at both ends of the second outlet liquid chamber 48*b* in the second direction Y have high flow path resistance as compared to the flow path resistance of the other individual outlet flow paths 50 for the same reason as the individual supply flow paths 39*a* and 39*b*. Therefore, in the present embodiment, a length L2' of the outlet flow path partition walls 53*a* and 53*b* that define the individual outlet flow paths 50*a* and 50*b* at both ends is set to be shorter than a length L2 of the outlet flow path partition wall 53 that define the other individual outlet flow paths 50 positioned closer to the center side in the first direction X. Accordingly, the flow path resistances of the individual outlet flow paths 50*a* and 50*b* at both ends and the flow path resistances of the other individual outlet flow paths 50 are aligned as much as possible. As a result, the ejection characteristics such as the ejected ink amount of each nozzle 28 in the nozzle row and the flight speed are aligned as much as possible. In the present embodiment, although an example is given of a configuration in which the lengths of the outlet flow path partition walls 53*a* and 53*b* defining the individual outlet flow paths 50*a* and 50*b* at both ends in the first direction X are set to be shorter than the lengths of the outlet flow path partition walls 53 of the other individual outlet flow paths 50, the configuration is not limited thereto. For example, it is also possible to adopt a configuration in which the lengths of the outlet flow path partition walls 53 corresponding to the plurality of individual outlet flow paths 50 at both end portions in the first direction X is gradually reduced from the center side toward the end side in the first direction X. Accordingly, the flow path resistance of each of the individual outlet flow paths 50 is more effectively aligned.

Narrowed portions 56 each having a flow path sectional area set to be small as compared to that of the individual outlet flow path 50 are provided at the boundary portion between each individual outlet flow path 50 and the second nozzle communication port 35. In the present embodiment, a portion protruding from the bottom surface of the thin portion 52 toward the bottom surface side of the second communication plate 25, in other words, toward the nozzle plate 20 side is formed and the protruding end surface is positioned slightly closer to the thin portion 52 side than the bottom surface of the second communication plate 25. The nozzle plate 20 is bonded to the bottom surface of the second communication plate 25 via the second flexible portion 54, so that the narrowed portion 56 is formed between the protruding portion and the nozzle plate 20. The narrowed portions 56 are flow paths causing the individual outlet flow paths 50 and the second nozzle communication ports 35 to communicate with each other, respectively, and impart flow path resistance to the ink flowing from the second nozzle communication ports 35 into the individual outlet flow paths 50. The narrowed portion 56 is not limited to one formed by a portion protruding from the thin portion 52, that is, one narrowing the flow path in the third direction Z, and for example, by partially increasing the thickness of the wall of the outlet flow path partition wall 53 to partially narrow the flow path width of the individual outlet flow path 50, it is possible to adopt a configuration of rendering the flow path sectional area of the individual outlet flow path 50 in the first direction X narrower than the other portions or a combination of these configurations.

The nozzle plate 20 having a plurality of nozzles 28 formed therein is bonded to the bottom surface of the second communication plate 25. The nozzle plate 20 in the present embodiment is configured by a silicon single crystal substrate, for example. The nozzle plate 20 is bonded by an adhesive or the like in a state in which the plurality of second nozzle communication ports 35 and the plurality of nozzles 28 individually communicate with each other at the bottom surface of the first communication plate 24. In the nozzle plate 20 in the present embodiment, a total of two nozzle groups (that is, nozzle rows) in which the plurality of nozzles 28 is arranged are lined up in the second direction Y. In the nozzle plate 20, a through hole penetrating the nozzle plate 20 in the thickness direction is provided in a region corresponding to the common outlet liquid chamber 48 positioned closer to the outside in the second direction Y than the nozzle group. The surface of the through hole on the second communication plate 25 side is sealed by the second flexible portion 54 and the surface of the through hole on the opposite side to the second communication plate 25 side is sealed by the fixed plate 23, and so, a second compliance space 55 is defined. The flexible region of the second flexible portion 54 defining the second compliance space 55 functions as the second compliance portion 43 which is displaced to the second common flow path 41 side or the second compliance space 55 side according to the pressure oscillation inside the second common flow path 41. Details of the second compliance portion 43 will be described later. The nozzle plate 20 may be made of a metal such as stainless steel.

Figure 6:
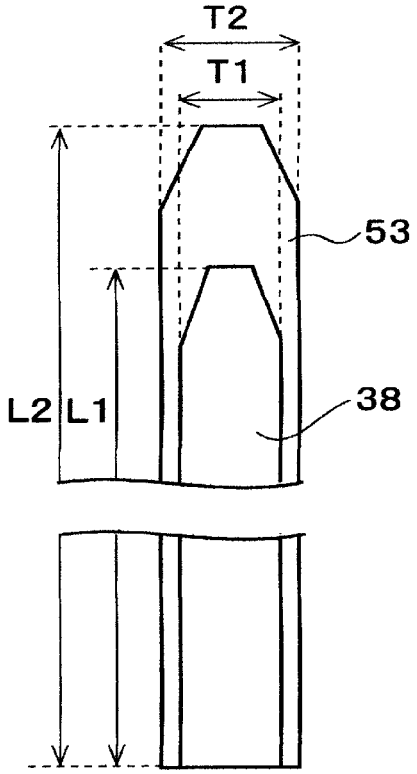
FIG. 6 is a schematic diagram comparing the positions and dimensions of a supply port partition wall and an outlet flow path partition wall.

FIG. 6 is a schematic diagram comparing the positions and dimensions of the supply port partition wall 38 and the outlet flow path partition wall 53 when viewed from the third direction Z in a bonded state in a state in which the first communication plate 24 and the second communication plate 25 are positioned. When each of the constituent members of the nozzle plate 20, the second communication plate 25, the first communication plate 24, and the actuator substrate 26 are laminated and bonded to each other, a load is applied in the laminating direction, that is, the third direction Z. In this regard, in the present embodiment, a thickness T2 of the outlet flow path partition wall 53 in the first direction X is set to be larger than a thickness T1 of the supply port partition wall 38 in the first direction X. The length L2 of the outlet flow path partition wall 53 in the first direction X is set to be larger than the length L1 of the supply port partition wall 38 in the second direction Y (in other words, the flow path extending direction). Therefore, in the supply port partition wall 38 and the outlet flow path partition wall 53 which are disposed at positions overlapping each other when viewed in the third direction Z, which is the laminating direction of each constituent member, a configuration is adopted in which the other supply port partition wall 38 is positioned within the range of the one outlet flow path partition wall 53. Since the dimensional relationship between the supply port partition wall 38 and the outlet flow path partition wall 53 is set in this manner, when the nozzle plate 20, the second communication plate 25, the first communication plate 24, and the actuator substrate 26 are bonded to each other, even if the relative positions of each of the constituent members deviate within a range of tolerance, the supply port partition wall 38 fits within the range of the outlet flow path partition wall 53, so that the partition walls 38 and 53 are capable of receiving the load during the bonding and it is possible to more reliably bond each of the constituent members, particularly the first communication plate 24 and the second communication plate 25. A configuration may be adopted in which the size relationship of the dimensions between the outlet flow path partition wall 53 and the supply port partition wall 38 is reversed. Depending on the positional relationship between the base ends of the partition walls in the second direction, that is, the end of the supply port partition wall 38 on the supply port 44 side and the end of the outlet flow path partition wall 53 on the second nozzle communication port 35 side, it is also conceivable to adopt a configuration in which the length of the partition wall having the larger thickness is shorter than the length of the other partition wall. In other words, in the second direction Y, it is anticipated that there is a case in which position of the base end of the partition wall having the smaller thickness is positioned closer to the nozzle 28 side than the position of the base end of the partition wall having the larger thickness. In this case, as long as a configuration is adopted in which the end of the thick partition wall on the common flow path side in the second direction Y is positioned closer to the common flow path side than the end of the thin partition wall on the common flow path side in the second direction Y, it is similarly possible to receive the load during the bonding using the partition wall, and it becomes possible to more reliably bond each of the constituent members, particularly the first communication plate 24 and the second communication plate 25, to each other.

Each of the constituent members of the nozzle plate 20, the second communication plate 25, the first communication plate 24, and the actuator substrate 26 is bonded to the case 27. As illustrated in FIG. 2, an accommodation space portion 58 accommodating the actuator substrate 26 is formed in the bottom surface side of the case 27 in the present embodiment. The first communication plate 24 is bonded to the bottom surface of the case 27 in a state in which the actuator substrate 26 is accommodated in the accommodation space portion 58. An insertion space portion 59 communicating with the accommodation space portion 58 is provided at a substantially central portion of the case 27 in plan view. The insertion space portion 59 also communicates with the wiring space portion 32*a* of the actuator substrate 26. The wiring member is configured to be inserted into the wiring space portion 32*a* through the insertion space portion 59. In the inner portion of the case 27, the inlet flow path 45 communicating with the common liquid chamber 37 of the first communication plate 24 is formed on both sides of the insertion space portion 59 and the accommodation space portion 58 in the second direction Y. Furthermore, the outlet flow paths 46 communicating with the communication liquid chambers 49 of the first communication plate 24 are formed closer to the outside in the second direction Y than the inlet flow paths 45, respectively. On the top surface of the case 27, inlets 62 communicating with each of the inlet flow paths 45 and outlets 63 communicating with the outlet flow paths 46 are provided. The inlet 62 is a portion at which the ink sent from the ink cartridge 13 side through the ink supply tube 15 is introduced via the flow path member 6. The outlet 63 is a portion at which the ink from the second common flow path 41 is sent to the ink cartridge 13 side via the flow path member 6. In the present embodiment, the ink sent from the ink cartridge 13 side by driving the pump 14 is introduced into the first common flow path 40 from the inlet 62. The ink introduced into the first common flow path 40 is supplied from each individual supply flow path 39 to each pressure chamber 30, and is supplied to the nozzle 28 through the first nozzle communication port 34 and the second nozzle communication port 35. The ink flowing from the second nozzle communication port 35 toward the second common flow path 41 through the narrowed portion 56 and the individual outlet flow path 50 passes from the outlet 63 through the ink recovery tube 16 via the flow path member 6 and is recovered in the ink cartridge 13 side. In other words, the ink is circulated between the ink cartridge 13 and the ink flow paths inside the recording head 10. In the present embodiment, the ink flow paths (that is, liquid flow paths) inside the recording head 10 are a series of flow paths from the inlet 62 reaching the first common flow path 40, the individual supply flow paths 39, the pressure chambers 30, the nozzle communication ports 34 and 35, the nozzles 28, the individual outlet flow paths 50, the second common flow path 41, and the outlet 63. The ink circulation path may be reversed. In other words, it is also possible to adopt a configuration in which the ink from the ink cartridge 13 is introduced into the second common flow path 41, passes through the nozzle communication ports 34 and 35 and the pressure chambers 30, and goes from the first common flow path 40 to the ink cartridge 13.

The fixed plate 23 is a plate material made of a metal such as stainless steel, for example. In the fixed plate 23 in the present embodiment, in order to expose the nozzles 28 at positions corresponding to the regions where the nozzles 28 are formed in the nozzle plate 20, openings 23*a* are formed in a state of penetrating in the thickness direction. In the present embodiment, the fixed plate 23 blocks the opening portion on the bottom surface side of the through hole formed in the nozzle plate 20 to partition a portion of the second compliance space 55.

Next, the first compliance portion 42 will be described. The first compliance space 51 is provided on the first communication plate 24 side of the second communication plate 25, that is, on the top surface side opposite to the second outlet liquid chamber 48*b* side. The first compliance space 51 is a recessed portion that is recessed from the top surface of the second communication plate 25 to the middle of the thin portion 52 in the thickness direction (that is, the third direction Z). The portion in which the opening surface of the first compliance space 51 is sealed by the first flexible portion 36 functions as the first compliance portion 42. A region of the first flexible portion 36 that is substantially deformable when pressure is applied is a flexible region. The first compliance space 51 in the present embodiment is open to the atmosphere through an atmosphere open path which is not illustrated. The first flexible portion 36 is made of a flexible thin material such as polyphenylene sulfide, a silicon nitride film, or a tantalum oxide film, for example. The second flexible portion 54, which will be described later, has a similar configuration to the first flexible portion 36. The first flexible portion 36 partitions a portion of the common liquid chamber 37, that is, a portion of the first common flow path 40. Hereinafter, the state of the flexible region of the first flexible portion 36 in a state in which the pressure oscillation accompanying the ink ejection from the nozzles 28 does not occur in the ink flow paths of the recording head 10 is referred to as an initial state. Although it is assumed that the flexible region of the first flexible portion 36 is substantially parallel to the opening surface of the first compliance space 51 in the initial state, the flexible region in the initial state may slightly bend to the first compliance space 51 side or the first common flow path 40 side, due to factors such as the weight of the flexible region itself and the weight and temperature of the ink inside the first common flow path 40. The first flexible portion 36 or the second flexible portion 54 may be made of a metal such as stainless steel.

The flexible region of the first flexible portion 36 of the first compliance portion 42 is displaced from the initial state (in other words, flexed) according to the pressure oscillation (in other words, pressure change) of the ink inside the first common flow path 40. More specifically, when the pressure of the ink inside the first common flow path 40 is higher than the internal pressure of the first compliance space 51, the flexible region of the first flexible portion 36 is displaced from the initial state to the first compliance space 51 side. When the pressure of the ink inside the first common flow path 40 is lower than the internal pressure of the first compliance space 51, the flexible region of the first flexible portion 36 is displaced from the initial state to the first common flow path 40 side. Accordingly, the pressure oscillation generated in the ink inside the ink flow path, particularly the ink inside the first common flow path 40 in accordance with the recording operation of the recording head 10, that is, the ink ejection operation, in other words, the residual oscillation after the ink ejection is alleviated. Here, a flat state in which the first flexible portion 36 is not flexed, in other words, in a state in which the first flexible portion 36 is parallel to the top and bottom surfaces of the substrate (that is, the first communication plate 24 in the present embodiment) on which the first compliance portion 42 is provided, the thickness direction of the first flexible portion 36 is the thickness direction of the first compliance portion 42. In the present embodiment, the thickness direction of the first compliance portion 42 is the third direction Z. Similarly, the thickness direction of the second compliance portion 43 described later is the third direction Z.

As illustrated in FIG. 4, the first compliance portion 42 is formed to span from one end to the other end of the first common flow path 40 in the first direction X and is formed to span from the end on the opposite side to the supply port 44 in the second direction Y to a point slightly in front of the supply port partition wall 38. Here, when an inner dimension, that is, the width of the individual supply flow path 39 in the arrangement direction of each of the individual supply flow paths 39 in the thin portion 47, that is, in the first direction X is denoted by W (hereinafter, the width of the individual supply flow path 39 is denoted by W1 and the width of the individual outlet flow path 50 is denoted by W2), an edge closest to the individual supply flow path 39 of the flexible region of the first flexible portion 36 in the extending direction of the individual supply flow path 39, that is, in the second direction Y, in other words, the end on the individual supply flow path 39 side in the second direction Y is disposed within W1 from the exit of the individual supply flow path 39 on the first common flow path 40 side. In the present embodiment, the end of the flexible region of the first compliance portion 42 is disposed within W1 from the exit on the first common flow path 40 side of the individual supply flow paths 39 other than the individual supply flow paths 39*a* and 39*b* positioned at both ends in the first direction X of the second liquid chamber 37*b*. By disposing the first compliance portion 42 as close as possible to the exit of the individual supply flow path 39 in this manner, the pressure oscillation transmitted through the inner portion of the individual supply flow path 39 is alleviated more quickly. In the present embodiment, the first compliance portion 42 is disposed at a position within W1 from the exit of the individual supply flow path 39 on the first common flow path 40 side and does not overlap each of the individual supply flow paths 39 when viewed in the third direction Z. As a result, since the flexible region of the first compliance portion 42 and the supply port partition wall 38 defining the individual supply flow path 39 do not interfere with each other, when the flexible region of the first compliance portion 42 is deformed, stress being focused on a portion in contact with the supply port partition wall 38 and the first flexible portion 36 of the first compliance portion 42 being damaged originating at the same portion, variation in the flow path resistance in each of the individual supply flow paths 39, and the like are prevented.

Figure 7:
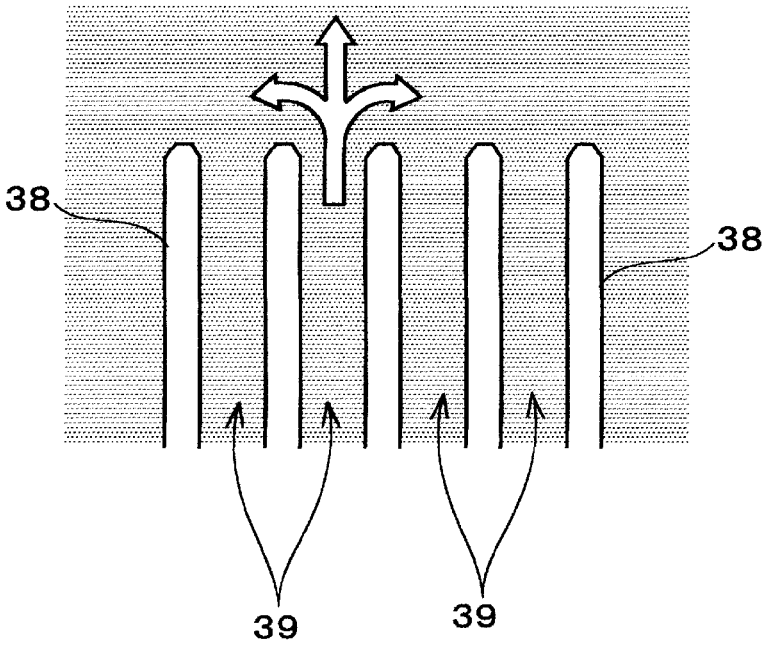
FIG. 7 is a schematic diagram explaining the flow of ink from individual supply flow paths toward a first common flow path side.
Figure 8:
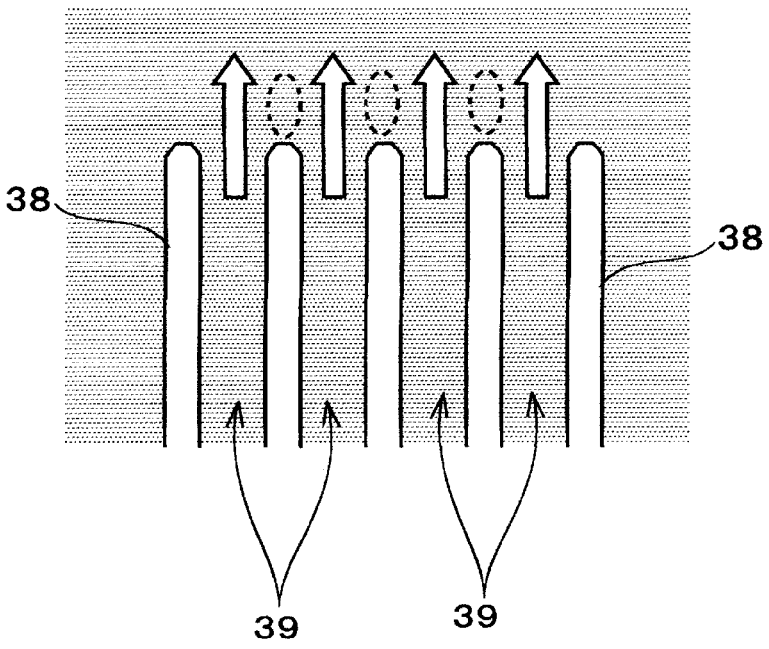
FIG. 8 is a schematic diagram explaining the flow of ink from the individual supply flow path toward the first common flow path side.

FIGS. 7 and 8 are schematic diagrams explaining the flow of ink from the individual supply flow paths 39 toward the first common flow path 40, that is, explaining the flow of ink when the pressure of the ink in the inner portion of the pressure chambers 30 increases in accordance with the ink ejection operation. Here, when ink is independently ejected from a predetermined nozzle 28, the ink flowing out from the exit of the individual supply flow path 39 corresponding to the nozzle 28 to the first common flow path 40 side is, as illustrated in FIG. 7, capable of dispersing over a relatively wide range in the first common flow path 40. On the other hand, when the ink is ejected from the plurality of nozzles 28 at the same time, as illustrated in FIG. 8, since the ink from the exits of the individual supply flow paths 39 adjacent to each other flows out at once toward the first common flow path 40 side, in the region indicated by the broken line in FIG. 8, the pressure in the vicinity of the exit of each of the individual outlet flow paths 50 increases as though the supply port partition wall 38 were extended. Therefore, the ink flowing out from the exit of the individual supply flow path 39 to the first common flow path 40 side may not go toward a lateral direction, that is, toward the adjacent individual supply flow path 39 side, and accordingly the flow path resistance increases. As a result, there is a concern that the ejection characteristics such as the amount of ejected ink and the flight speed may vary depending on the number of nozzles 28 that eject simultaneously. In order to deal with such a problem, in the present embodiment, since the first compliance portion 42 is disposed within W1 from the exit of the individual supply flow path 39 on the first common flow path 40 side, it is possible to reduce the variation in the ejection characteristics regardless of the number of nozzles 28 that perform the ejection simultaneously.

Next, the second compliance portion 43 will be described. As described above, the nozzle plate 20 is provided with the second compliance portion 43. Similarly to the first compliance space 51, the second compliance space 55 of the second compliance portion 43 is also open to the atmosphere through an atmosphere open path which is not illustrated. The second flexible portion 54 of the second compliance portion 43 partitions a portion of the second common flow path 41. Similarly to the first compliance portion 42, the flexible region of the second flexible portion 54 of the second compliance portion 43 is displaced from the initial state to the second compliance space 55 or the second common flow path 41 side in accordance with the pressure oscillation of the ink inside the second common flow path 41. Accordingly, the pressure oscillation generated in the ink inside the ink flow paths, particularly the ink inside the second common flow path 41 in accordance with the recording operation of the recording head 10, that is, the ink ejection operation, in other words, the residual oscillation after the ink ejection is alleviated.

As illustrated in FIG. 5, the second compliance portion 43 is formed to span from one end to the other end of the second common flow path 41 in the first direction X and is formed to span from the end on the opposite side to the supply port 44 in the second direction Y to a point slightly in front of the outlet flow path partition wall 53. More specifically, setting the width of the individual outlet flow path 50 to W2, the edge of the flexible region of the second flexible portion 54 that is closest to the individual outlet flow path 50 in the second direction Y, in other words, the end on the individual outlet flow path 50 side in the second direction Y is disposed within W2 from the exit of the individual outlet flow path 50 on the second common flow path 41 side. In the present embodiment, the end of the flexible region of the second compliance portion 43 is disposed within W2 from the exit on the second common flow path 41 side of the individual outlet flow paths 50 other than the individual outlet flow paths 50*a* and 50*b* positioned at both ends in the first direction X of the second liquid chamber 37*b*. The exit of the second common flow path 41 side is an opening of the individual outlet flow path 50 defined by the end of the outlet flow path partition wall 53 partitioning the individual outlet flow path 50 on the second common flow path 41 side. In this manner, by disposing the second compliance portion 43 as close as possible to the exit of the individual outlet flow path 50, the pressure oscillation transmitted in the inner portion of the individual outlet flow path 50 is alleviated more quickly. In the present embodiment, the second compliance portion 43 is disposed at a position within W2 from the exit of the individual outlet flow path 50 on the second common flow path 41 side and does not overlap each of the individual outlet flow paths 50 when viewed in the third direction Z. As a result, since the flexible region of the second compliance portion 43 and the supply port partition wall 38 defining the individual outlet flow path 50 do not interfere with each other, when the flexible region of the first compliance portion 42 is deformed, stress being focused on a portion in contact with the outlet flow path partition wall 53 and the second flexible portion 54 of the first compliance portion 42 being damaged originating at the same portion, variation in the flow path resistance in each of the individual outlet flow paths 50, and the like are prevented.

In the recording head 10 of the configuration described above, the piezoelectric elements 31 are driven according to the drive signals from a control section, so that the pressure oscillation occurs in the ink inside the pressure chambers 30 and the pressure oscillation causes the ink to be ejected from the predetermined nozzles 28. The first flexible portion 36 of the first compliance portion 42 on the outward path side of the ink flow path and the second flexible portion 54 of the second compliance portion 43 on the return path side of the ink flow path are respectively displaced in accordance with the pressure oscillation generated inside the ink flow path due to the liquid ejection operation of the recording head 10, and so the pressure oscillation is absorbed. Accordingly, variation in the ejection characteristics caused by the pressure oscillation which is the residual oscillation after the ink ejection is suppressed.

In the recording head 10 according to the present disclosure, the first compliance portion 42 and the second compliance portion 43 are disposed to overlap each other when viewed in the thickness direction of the compliance portions 42 and 43, that is, in the third direction Z in the present embodiment, in other words, to overlap each other. In the present embodiment, the third direction Z and the thickness direction of the nozzle plate 20 are parallel. In other words, in the present embodiment, the first compliance portion 42 and the second compliance portion 43 are disposed to overlap each other in the thickness direction of the nozzle plate 20. That the first compliance portion 42 and the second compliance portion 43 "overlap" in the thickness direction of the nozzle plate 20 means that the first compliance portion 42 and the second compliance portion 43 face each other in the thickness direction of the nozzle plate 20. That the first compliance portion 42 and the second compliance portion 43 "face each other" includes both a case in which is no other object is present between the first compliance portion 42 and the second compliance portion 43 and a case in which another object is present between the first compliance portion 42 and the second compliance portion 43. That the first compliance portion 42 and the second compliance portion 43 "overlap" in the thickness direction of the nozzle plate 20 also means that, when the first compliance portion 42 and the second compliance portion 43 are projected onto a projection plane perpendicular to the thickness direction of the nozzle plate 20, there is a region in which the first compliance portion 42 and the second compliance portion 43 overlap on the projection plane. Here, although the state in which the first compliance portion 42 and the second compliance portion 43 overlap each other includes a state in which the two partially overlap, a state in which greater than or equal to half of the area of each of the compliance portions 42 and 43 overlaps is more desirable. When the area of the first compliance portion 42 and the area of the second compliance portion 43 are the same, a state in which the entirety of the two overlap each other is more desirable. Alternatively, when one of the areas of the first compliance portion 42 and the second compliance portion 43 is smaller than the other area, a state in which the flexible region of the smaller is contained within the range of the flexible region of the larger, that is, a state in which one is contained in the other is more preferable.

In the present embodiment, the area of the second compliance portion 43 is set wider than the area of the first compliance portion 42 and each of the compliance portions 42 and 43 is disposed such that the flexible region of the first compliance portion 42 is contained within the range of the flexible region of the second compliance portion 43 when viewed in the third direction Z. In this manner, by setting the area of the flexible region of the second compliance portion 43 on the return path side of the compliance portions 42 and 43 to be larger, the compliance of the second compliance portion 43 is rendered larger than the compliance of the first compliance portion 42. Compliance [$m^3$/N] means the deformation amount per unit pressure. Here, in the configuration in which the ink circulates between the ink cartridge 13 and the recording head 10, there is a case in which the pressure oscillation during the driving of the pump 14 which is the circulation mechanism, that is, a pulsation is superimposed on the pressure oscillation during the ink ejection and the pressure oscillation of the ink in the second common flow path 41 becomes large, and in such a case, the ink of the second common flow path 41 flows back to the pressure chamber 30 side through the individual outlet flow paths 50, which there is a concern will cause the ejection characteristics to fluctuate from the target values.

In the present embodiment, by setting the compliance of the second compliance portion 43 on the return path side to be larger, even when the pressure oscillation during driving of the pump 14 is superimposed on the pressure oscillation during the ink ejection, it is possible to sufficiently reduce the oscillation using the second compliance portion 43 and the adverse effects on the ink ejection characteristics are more reliably suppressed. Note that the magnitude of the compliance in the compliance portion is not limited to the area of the flexible region, and may be adjusted by modifying the material or thickness of the flexible portion, for example. It is also possible to adopt a configuration in which the compliance of the first compliance portion 42 or the second compliance portion 43 closer to the nozzle 28 is larger than the compliance of the farther from the nozzle 28. In the present embodiment, even from this perspective, the compliance of the second compliance portion 43 disposed at a position closer to the nozzle 28 is larger than the compliance of the first compliance portion 42. According to this configuration, it is possible to more reliably reduce the pressure oscillation generated by the ink ejection in the nozzle 28 at a position closer to the nozzle 28. Accordingly, fluctuations in the ink ejection characteristics from the nozzle 28 from the target values are more reliably suppressed.

As described above, according to the present disclosure, in the configuration in which ink is circulated between the ink cartridge 13 and the recording head 10, even if the first common flow path 40 that configures the outward path from the ink cartridge 13 side to the pressure chamber 30 side and the second common flow path 41 that configures the return path from the pressure chamber 30 side returning to the ink cartridge 13 side are provided with the compliance portions 42 and 43, respectively, it is possible to suppress an increase in size of the recording head 10. Accordingly, this also contributes to reducing the size of the printer 1 equipped with the recording head 10. Since the plurality of pressure chambers 30, in other words, the first common flow path 40 and the second common flow path 41 shared by the plurality of nozzles 28 are provided with the compliance portions 42 and 43, respectively, as compared to a configuration in which the individual flow paths, that is, the individual supply flow paths 39 and the individual outlet flow paths 50 are provided individually with compliance portions, respectively, it is possible to more efficiently suppress the pressure oscillation generated in accordance with the ink ejection operation in each of the pressure chambers 30. Therefore, even when ink is ejected from each of the nozzles 28 at a higher drive frequency, since it is possible to more reliably suppress the pressure oscillations generated in accordance with the ejection operation, it is possible to handle the ink ejection at a higher drive frequency.

In the present embodiment, as illustrated in FIG. 2, since the pair of first common flow paths 40 are disposed between the pair of second common flow paths 41 in the second direction Y, which is the direction in which the nozzle groups are arranged and the nozzle groups are disposed between the first common flow paths 40, it is possible to dispose the nozzle groups at a higher density. In the inner portion of the recording head 10, it is possible to more efficiently lay out the ink flow paths including the common flow paths 40 and 41 and the pressure chambers 30 corresponding to each nozzle group, or the piezoelectric elements 31 and this contributes to reducing the size of the recording head 10. In the second direction Y, since the second common flow path 41 is disposed on the outside of the first common flow path 40, it is possible to secure a larger area of the second compliance portion 43 corresponding to the second common flow path 41.

Figure 9:
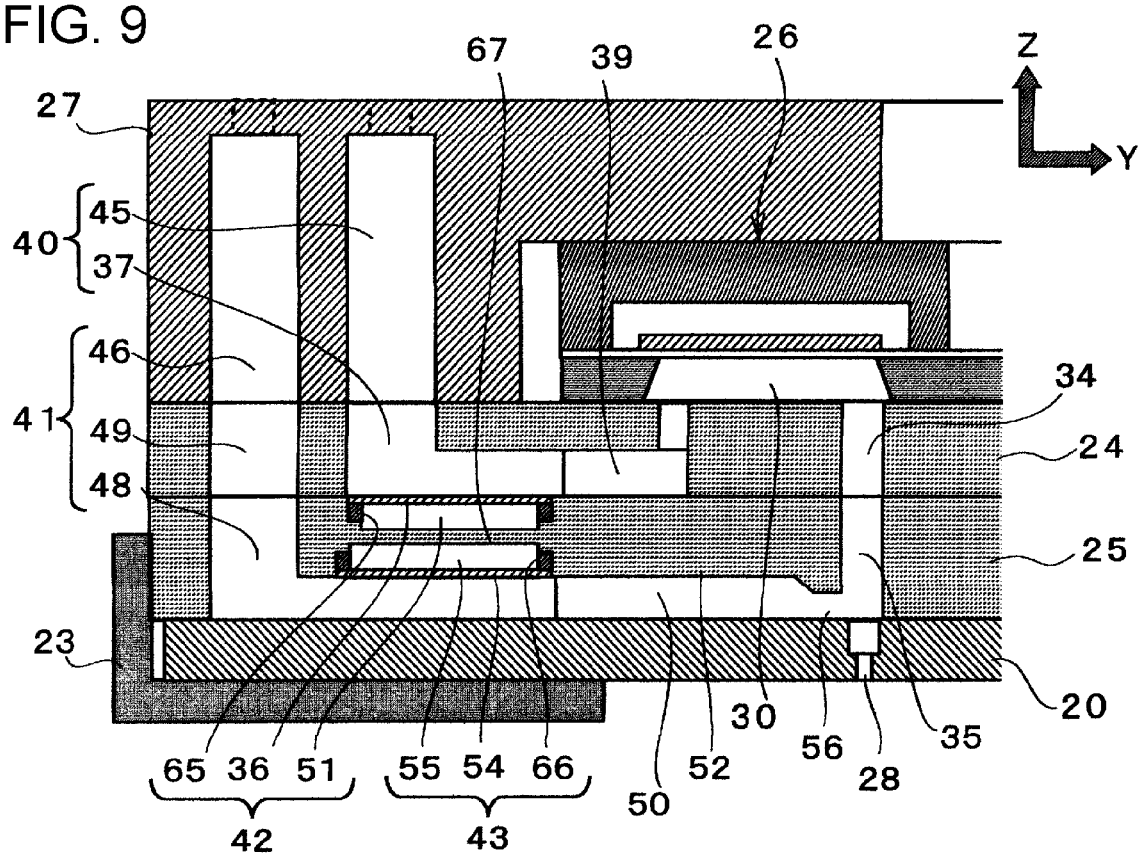
FIG. 9 is a sectional diagram explaining the configuration of a liquid ejecting head according to a second embodiment.
Figure 10:
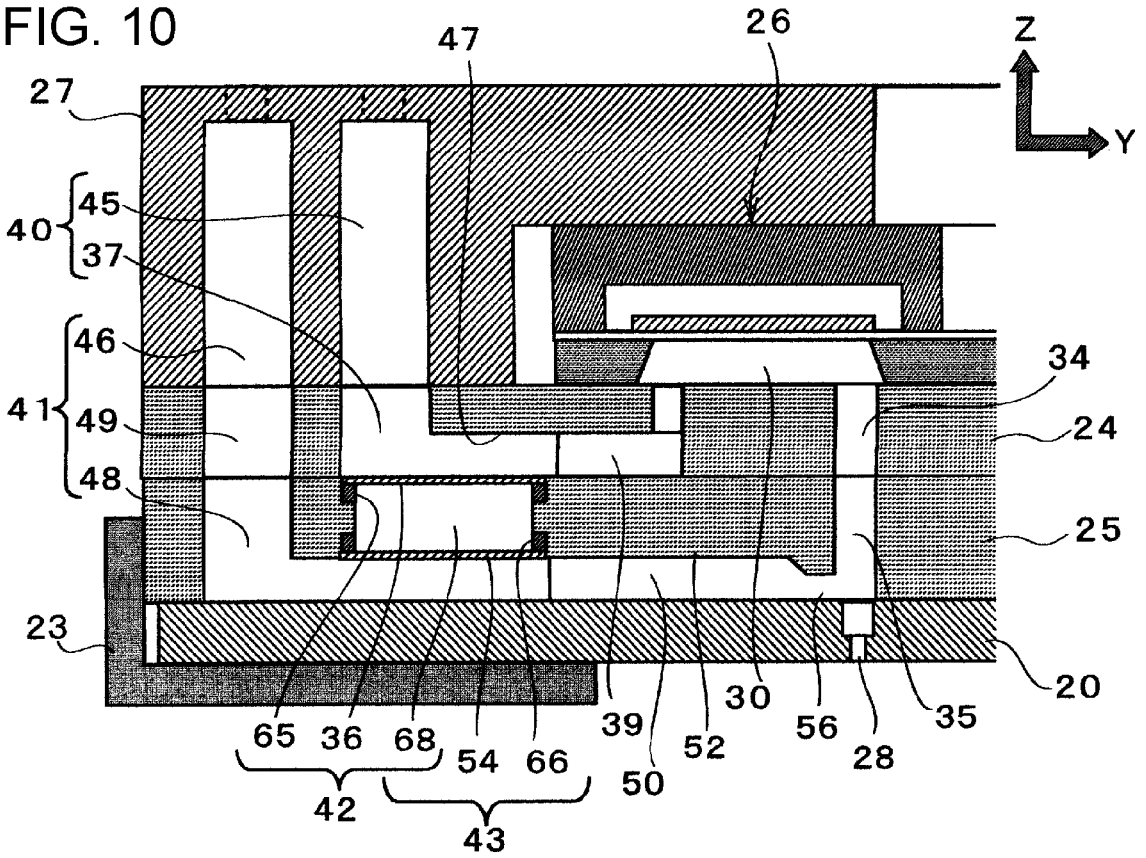
FIG. 10 is a sectional diagram explaining a modification example of the configuration of the liquid ejecting head according to the second embodiment.

FIG. 9 is a sectional diagram illustrating the recording head 10 according to the second embodiment, and FIG. 10 is a sectional diagram illustrating a modification example of the recording head 10 according to the second embodiment. In the present embodiment, the second communication plate 25 is provided with the first compliance portion 42 and the second compliance portion 43. The first compliance portion 42 corresponding to the first common flow path 40, similarly to the first embodiment, is provided in a region corresponding to the first common flow path 40 on the top surface side of the second communication plate 25, more specifically, on the top surface side of the thin portion 52. The first compliance portion 42 in the present embodiment is configured of the first flexible portion 36, a first support plate 65 supporting the first flexible portion 36, and the first compliance space 51. The first support plate 65 is formed of a hard material such as stainless steel capable of supporting the first flexible portion 36, for example. The first support plate 65 has a frame shape with a central portion penetrating in plan view in the third direction Z and the first flexible portion 36 is fixed to the frame-shaped portion. The first support plate 65 is fitted and bonded to the step provided in the opening portion of the first compliance space 51. In other words, the first flexible portion 36 in the present embodiment is provided only in the portion corresponding to the first compliance portion 42.

The second compliance portion 43 in the present embodiment is provided in a region corresponding to the second common flow path 41 on the bottom surface side of the thin portion 52 of the second communication plate 25. The second compliance space 55 of the second compliance portion 43 is formed on the bottom surface side of the thin portion 52 with a dividing wall 67 interposed between the second compliance space 55 and the first compliance space 51 of the first compliance portion 42. The second compliance portion 43 in the present embodiment is configured of the second flexible portion 54, a second support plate 66 supporting the second flexible portion 54, and the second compliance space 55. In the same manner as the first support plate 65, the second support plate 66 is formed in a frame shape from a hard material such as stainless steel and the second flexible portion 54 is fixed to the frame-shaped portion. The second support plate 66 is fitted and bonded to the step provided in the opening portion of the second compliance space 55. In the present embodiment, although a configuration in which the first compliance space 51 and the second compliance space 55 are rendered separate spaces from each other by the dividing wall 67 is exemplified, for example, as illustrated in FIG. 10, it is also possible to adopt a configuration in which the dividing wall 67 is absent and both are connected in series. In other words, the first compliance portion 42 and the second compliance portion 43 may share one common compliance space 68. The other configurations are similar to those of the first embodiment.

Figure 11:
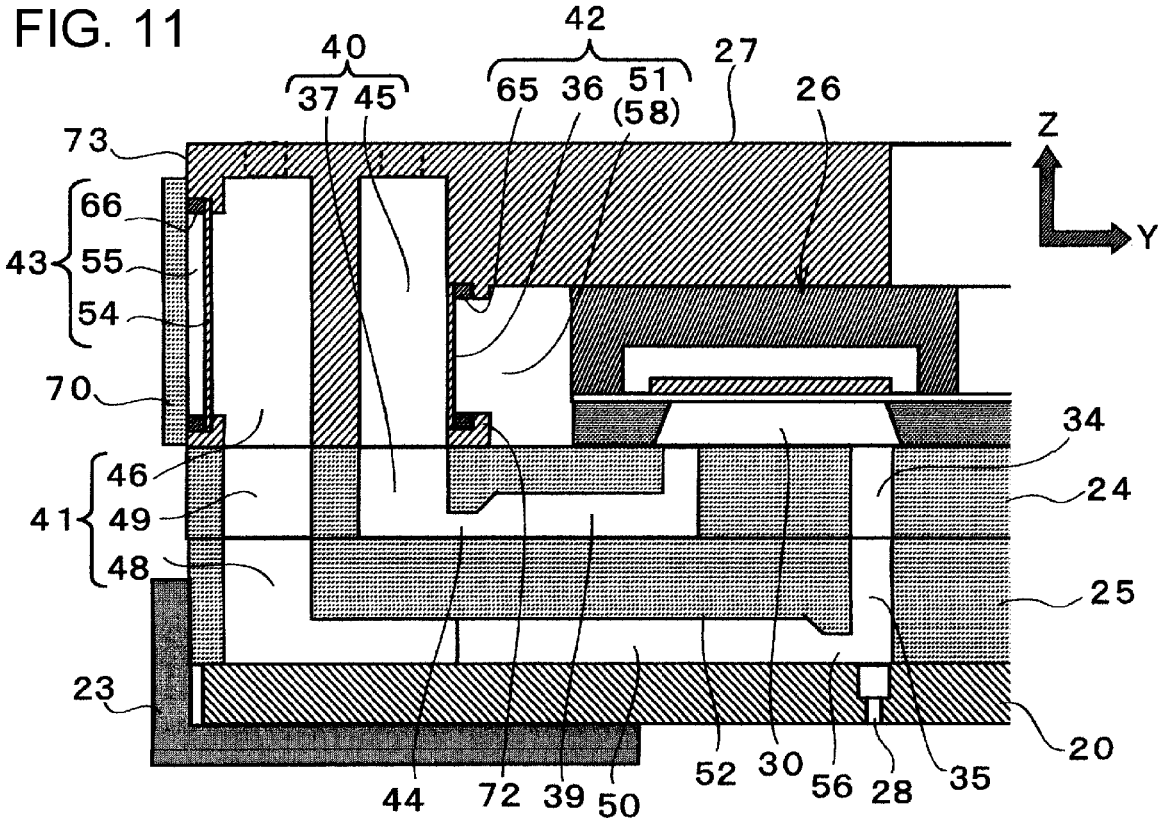
FIG. 11 is a sectional diagram explaining the configuration of a liquid ejecting head according to a third embodiment.

FIG. 11 is a sectional diagram of the recording head 10 according to the third embodiment. In each of the above embodiments, a configuration is exemplified in which the thickness direction of each of the compliance portions 42 and 43 is the laminating direction of the constituent members of the recording head 10, that is, the third direction Z, but the present invention is not limited thereto. In the present embodiment, the first compliance portion 42 is provided on the wall surface of the inlet flow path 45 configuring the first common flow path 40 in the case 27 along the third direction Z. More specifically, an opening portion is provided in a defining wall 72 partitioning the inlet flow path 45 and the accommodation space portion 58 accommodating the actuator substrate 26, and the first compliance portion 42 is provided so as to block the opening portion. The first compliance portion 42 is configured to use the accommodation space portion 58 as the first compliance space 51. Therefore, it is not necessary to separately provide the first compliance space 51, which contributes to reducing the size of the recording head 10. The second compliance portion 43 is provided on the wall surface along the third direction Z of the outlet flow path 46 configuring the second common flow path 41 in the case 27. More specifically, an opening portion communicating with the outlet flow path 46 is provided in an outer wall surface 73 on both sides of the case 27 in the second direction Y and the second compliance portion 43 is provided to block the opening portion. A protective plate 70 for protecting the second flexible portion 54 of the second compliance portion 43 is bonded to a portion of the outer wall surface 73 of the case 27 corresponding to the second compliance portion 43. The space between the protective plate 70 and the second flexible portion 54 functions as the second compliance space 55. In the present embodiment, the thickness direction of the compliance portions 42 and 43 is the second direction Y intersecting the first direction X which is the nozzle row direction. Even in the present embodiment, the first compliance portion 42 and the second compliance portion 43 are disposed to overlap each other when viewed in the thickness direction of the compliance portions 42 and 43, that is, in the second direction Y in the present embodiment. Therefore, it is possible to reduce the size of the recording head 10.

In the present embodiment, the supply port 44 is provided as a narrowed portion in which the flow path sectional area is set to be smaller than the flow path sectional area of the individual supply flow path 39 at the boundary portion between the first common flow path 40 extending in the third direction Z and the individual supply flow path 39 extending in the second direction Y. Accordingly, even if bubbles are mixed into the ink sent from the ink cartridge 13 side to the first common flow path 40, the bubbles having a size that influences the ink ejection of from the nozzles 28 may not pass through the supply port 44 and are trapped. The bubbles that remain unable to pass through the supply port 44 float upstream of the first common flow path 40 due to buoyancy. Therefore, it is possible to more effectively suppress the adverse influence of such bubbles on the ink ejection. The other configurations are similar to those of the first embodiment.

Figure 12:
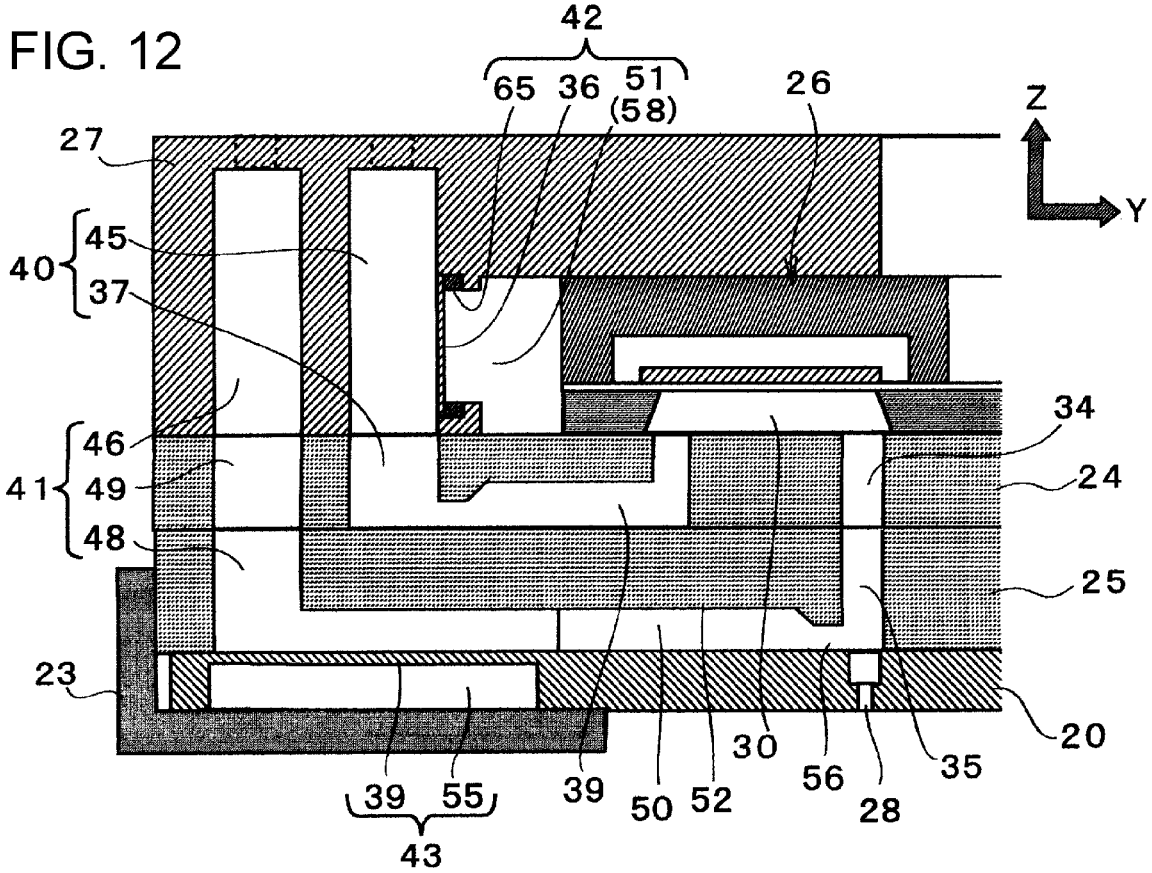
FIG. 12 is a sectional diagram explaining the configuration of a liquid ejecting head according to a fourth embodiment.

FIG. 12 is a sectional diagram of the recording head 10 according to the fourth embodiment. In the present embodiment, the first compliance portion 42 is provided on the defining wall 72 partitioning the inlet flow path 45 and the accommodation space portion 58 accommodating the actuator substrate 26 in the case 27 in the same manner as in the third embodiment. On the other hand, the second compliance portion 43 is provided in a region of the nozzle plate 20 corresponding to the common outlet liquid chamber 48. In the present embodiment, the thickness direction of the first compliance portion 42 is the second direction Y, whereas the thickness direction of the second compliance portion 43 is the third direction Z. In this configuration, the first compliance portion 42 and the second compliance portion 43 are disposed to overlap each other when viewed in the thickness direction of the second compliance portion 43, that is, the third direction Z. In this manner, even in a configuration in which the compliance portions 42 and 43 overlap each other when viewed in the thickness direction of either the first compliance portion 42 or the second compliance portion 43, it is possible to contribute to a reduction in the size of the recording head 10. Further, regarding the second compliance portion 43 in the present embodiment, a recessed portion is formed leaving a thin portion functioning as the second flexible portion 54 from the bottom surface side of the nozzle plate 20 toward the top surface side and the second compliance space 55 is defined by the bottom surface side opening of the recessed portion being blocked by the fixed plate 23. By partially reducing the thickness of the constituent members of the recording head 10 in this manner and causing the portion to function as the flexible portion, it is not necessary to separately provide the flexible portion. The other configurations are similar to those of the first embodiment.

Figure 13:
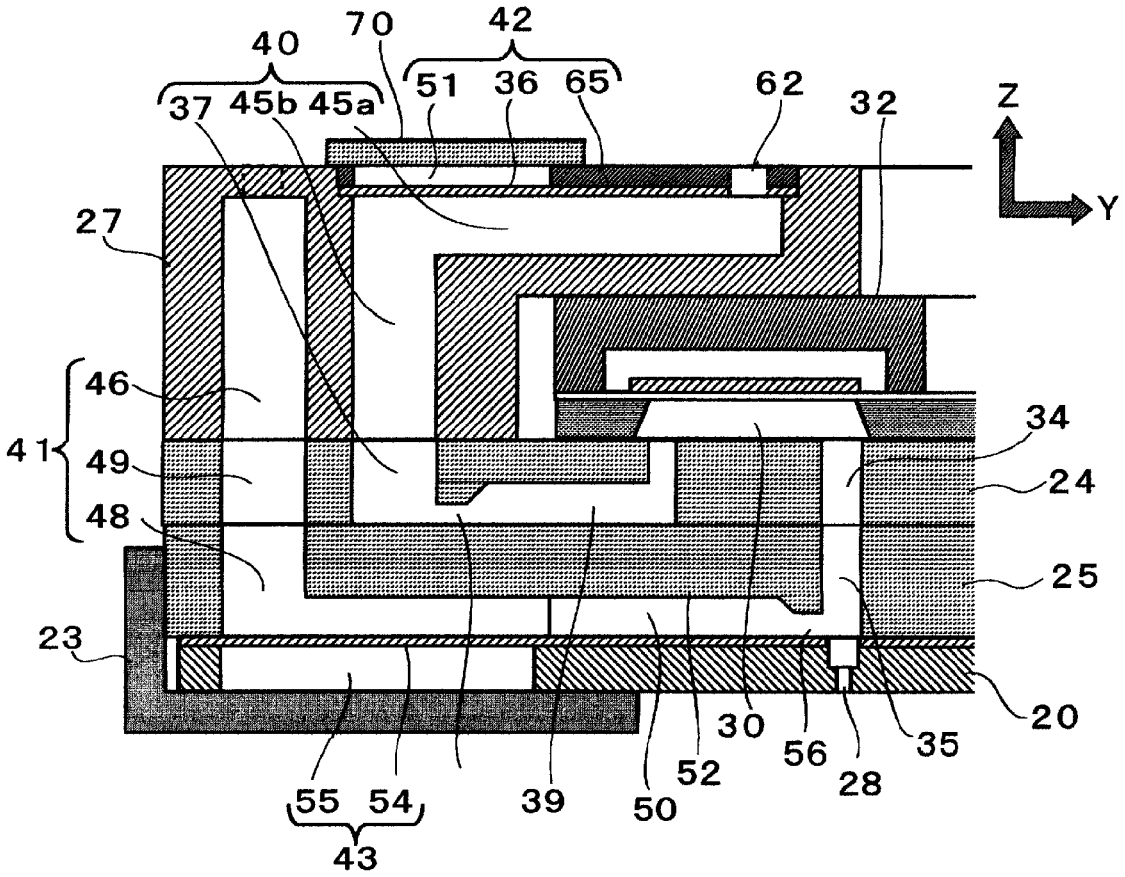
FIG. 13 is a sectional diagram explaining the configuration of a liquid ejecting head according to a fifth embodiment.

FIG. 13 is a sectional diagram of the recording head 10 according to the fifth embodiment. In the present embodiment, the second compliance portion 43 is provided in a region of the nozzle plate 20 corresponding to the common outlet liquid chamber 48 in the same manner as in the first embodiment. On the other hand, the first compliance portion 42 is provided on the top surface side of the case 27 in the third direction Z. The inlet flow path 45 of the first common flow path 40 in the present embodiment is configured of the first inlet flow path 45*a* extending in a direction parallel to the top and bottom surfaces of the case 27 and the second inlet flow path 45*b* communicating with the first inlet flow path 45*a* extending along the third direction Z from the top surface side toward the bottom surface side of the case 27. The first inlet flow path 45*a* is open in the top surface of the case 27 and the opening surface is sealed by the first support plate 65 of the first compliance portion 42. One surface of the through hole provided in the first support plate 65, that is, the surface on the first common flow path 40 side is sealed by the first flexible portion 36, and the other surface, that is, the surface of the top surface side of the case 27 is sealed by the protective plate 70, and thus, the first compliance space 51 is defined. An inlet 62 is formed at a position outside the first compliance space 51, penetrating the first support plate 65 and the first flexible portion 36. Even in the present embodiment, the first compliance portion 42 and the second compliance portion 43 are disposed to overlap each other when viewed in the thickness direction of the compliance portions 42 and 43, that is, in the third direction Z in the present embodiment. Therefore, it is possible to reduce the size of the recording head 10. The other configurations are similar to those of the first embodiment.

In addition, it is possible to apply the present disclosure to various configurations of liquid ejecting head and liquid ejecting apparatus provided with the liquid ejecting head where the liquid ejecting head is configured to include a flow path corresponding to an outward path and a flow path corresponding to a return path in which circulation of a liquid with a liquid storage portion is possible and a compliance portion is included in each of the outward path and the return path. For example, it is possible to apply the present disclosure to a liquid ejecting head and a liquid ejecting apparatus provided with the liquid ejecting head, where the liquid ejecting head is provided with a plurality of color material ejecting heads used in the manufacture of a color filter of a liquid crystal display or the like, electrode material ejecting heads used in electrode formation of an organic EL (Electro Luminescence) display, an FED (face emitting display), or the like, bioorganic material ejecting heads used in manufacturing biochips (biochemical elements), or the like.

REFERENCE SIGNS LIST

1 PRINTER
2 FRAME
3 PLATEN
4 GUIDE ROD
5 CARRIAGE
6 FLOW PATH MEMBER
10 RECORDING HEAD
13 INK CARTRIDGE
14 PUMP
15 INK SUPPLY TUBE
16 INK RECOVERY TUBE
20 NOZZLE PLATE
21 CAPPING MECHANISM
22 CAP
23 FIXED PLATE
24 FIRST COMMUNICATION PLATE
25 SECOND COMMUNICATION PLATE
26 ACTUATOR SUBSTRATE
27 CASE
28 NOZZLE
29 PRESSURE CHAMBER FORMING SUBSTRATE
30 PRESSURE CHAMBER
31 PIEZOELECTRIC ELEMENT
32 PROTECTIVE SUBSTRATE
33 OSCILLATING PLATE
34 FIRST NOZZLE COMMUNICATION PORT
35 SECOND NOZZLE COMMUNICATION PORT
36 FIRST FLEXIBLE PORTION
37 COMMON LIQUID CHAMBER
38 SUPPLY PORT PARTITION WALL
39 INDIVIDUAL SUPPLY FLOW PATH

40 FIRST COMMON FLOW PATH
41 SECOND COMMON FLOW PATH
42 FIRST COMPLIANCE PORTION
43 SECOND COMPLIANCE PORTION
44 SUPPLY PORT
45 INLET FLOW PATH
46 OUTLET FLOW PATH
47 THIN PORTION
48 COMMON OUTLET LIQUID CHAMBER
49 COMMUNICATION LIQUID CHAMBER
50 INDIVIDUAL OUTLET FLOW PATH
51 FIRST COMPLIANCE SPACE
52 THIN PORTION
53 OUTLET FLOW PATH PARTITION WALL
54 SECOND FLEXIBLE PORTION
55 SECOND COMPLIANCE SPACE
56 NARROWED PORTION
58 ACCOMMODATION SPACE PORTION
59 INSERTION SPACE PORTION
62 INLET
63 OUTLET
65 FIRST SUPPORT PLATE
66 SECOND SUPPORT PLATE
67 DIVIDING WALL
68 COMMON COMPLIANCE SPACE
70 PROTECTIVE PLATE
72 DEFINING WALL
73 OUTER WALL SURFACE

The invention claimed is:

1. A liquid ejecting head, comprising:
a plurality of pressure chambers communicating with a plurality of nozzles that eject a liquid;
a first common flow path through which the liquid is supplied to the plurality of pressure chambers side;
a second common flow path through which the liquid is led out from the plurality of pressure chambers side;
a first compliance portion that deforms in response to a pressure change in the liquid inside the first common flow path; and
a second compliance portion that deforms in response to a pressure change in the liquid inside the second common flow path, wherein
the first compliance portion and the second compliance portion overlap each other when viewed in a thickness direction of at least one of the compliance portions, and
a compliance of one of the first compliance portion and the second compliance portion that is closer to the nozzles is larger than a compliance of the other that is farther from the nozzles.

2. A liquid ejecting head, comprising:
a plurality of pressure chambers communicating with a plurality of nozzles that eject a liquid;
a first common flow path through which the liquid is supplied to the plurality of pressure chambers side;
a second common flow path through which the liquid is led out from the plurality of pressure chambers side;
a first compliance portion that deforms in response to a pressure change in the liquid inside the first common flow path; and
a second compliance portion that deforms in response to a pressure change in the liquid inside the second common flow path, wherein
the first compliance portion and the second compliance portion overlap each other when viewed in a thickness direction of at least one of the compliance portions, and
a compliance of the second compliance portion is larger than a compliance of the first compliance portion.

3. A liquid ejecting head, comprising:
a plurality of pressure chambers communicating with a plurality of nozzles that eject a liquid;
a first common flow path through which the liquid is supplied to the plurality of pressure chambers side;
a second common flow path through which the liquid is led out from the plurality of pressure chambers side;
a first compliance portion that deforms in response to a pressure change in the liquid inside the first common flow path;
a second compliance portion that deforms in response to a pressure change in the liquid inside the second common flow path; and
a plurality of individual outlet flow paths that individually allows communication from the pressure chambers to the second common flow path, wherein
the first compliance portion and the second compliance portion overlap each other when viewed in a thickness direction of at least one of the compliance portions, and
the second compliance portion does not overlap the plurality of individual outlet flow paths when viewed in a thickness direction of the second compliance portion.

4. The liquid ejecting head according to claim 3, wherein
when an inner dimension of the individual outlet flow paths in a flow path arrangement direction of the plurality of individual outlet flow paths is denoted by W, in a flow path extending direction of the individual outlet flow path, an edge of a displaceable flexible region of the second compliance portion in the second common flow path that is closest to the individual outlet flow path is disposed within W from an exit of the individual outlet flow path on the second common flow path side.

5. The liquid ejecting head according to claim 3, further comprising:
a plurality of individual supply flow paths that individually allows communication from the first common flow path to the plurality of pressure chambers, wherein
the first compliance portion does not overlap the plurality of individual supply flow paths when viewed in a thickness direction of the first compliance portion.

6. The liquid ejecting head according to claim 5, wherein
a thickness of one of a first partition wall separating the plurality of individual supply flow paths or a second partition wall separating the plurality of individual outlet flow paths is thicker than a thickness of the other in the flow path arrangement direction, and a length of the one is longer than a length of the other in the flow path extending direction.

7. The liquid ejecting head according to claim 3, wherein
a position of an exit of the individual outlet flow path on the second common flow path side in the flow path extending direction positioned closer to end sides in the flow path arrangement direction of the plurality of individual outlet flow paths and a position of an exit of the individual outlet flow paths on the second common flow path side positioned closer to a center side in the flow path arrangement direction are different.

8. The liquid ejecting head according claim 1, wherein
two nozzle groups formed by arranging the nozzles are arranged in a direction perpendicular to an arrangement direction of the nozzles;
two first common flow paths forming a pair are disposed between two second common flow paths forming a pair in the arrangement direction of the nozzle groups; and
the nozzle groups are disposed between the two first common flow paths.

9. A liquid ejecting apparatus comprising:

the liquid ejecting head according to claim 1;

a liquid storage portion storing a liquid to be supplied to the liquid ejecting head; and a circulation mechanism for circulating the liquid between the liquid storage portion and the liquid ejecting head.

10. The liquid ejecting head according to claim 1, further comprising:

a plurality of individual outlet flow paths that individually allows communication from the pressure chambers to the second common flow path, wherein the second compliance portion does not overlap the plurality of individual outlet flow paths when viewed in a thickness direction of the second compliance portion.

11. The liquid ejecting head according to claim 1, further comprising:

a plurality of individual supply flow paths that individually allows communication from the first common flow path to the plurality of pressure chambers, wherein the first compliance portion does not overlap the plurality of individual supply flow paths when viewed in a thickness direction of the first compliance portion.

12. The liquid ejecting head according to claim 11, wherein a thickness of one of a first partition wall separating the plurality of individual supply flow paths or a second partition wall separating a plurality of individual outlet flow paths that individually allow communication from the pressure chambers to the second common flow path is thicker than a thickness of the other in the flow path arrangement direction, and a length of the one is longer than a length of the other in the flow path extending direction.

13. The liquid ejecting head according to claim 2, wherein two nozzle groups formed by arranging the nozzles are arranged in a direction perpendicular to an arrangement direction of the nozzles;

two first common flow paths forming a pair are disposed between two second common flow paths forming a pair in the arrangement direction of the nozzle groups; and the nozzle groups are disposed between the two first common flow paths.

14. A liquid ejecting apparatus comprising:

the liquid ejecting head according to claim 2;

a liquid storage portion storing a liquid to be supplied to the liquid ejecting head; and a circulation mechanism for circulating the liquid between the liquid storage portion and the liquid ejecting head.

15. The liquid ejecting head according to claim 2, further comprising:

a plurality of individual outlet flow paths that individually allows communication from the pressure chambers to the second common flow path, wherein the second compliance portion does not overlap the plurality of individual outlet flow paths when viewed in a thickness direction of the second compliance portion.

16. The liquid ejecting head according to claim 2, further comprising:

a plurality of individual supply flow paths that individually allows communication from the first common flow path to the plurality of pressure chambers, wherein the first compliance portion does not overlap the plurality of individual supply flow paths when viewed in a thickness direction of the first compliance portion.

17. The liquid ejecting head according to claim 16, wherein a thickness of one of a first partition wall separating the plurality of individual supply flow paths or a second partition wall separating a plurality of individual outlet flow paths that individually allow communication from the pressure chambers to the second common flow path is thicker than a thickness of the other in the flow path arrangement direction, and a length of the one is longer than a length of the other in the flow path extending direction.

18. A liquid ejecting apparatus comprising:

the liquid ejecting head according to claim 3;

a liquid storage portion storing a liquid to be supplied to the liquid ejecting head; and a circulation mechanism for circulating the liquid between the liquid storage portion and the liquid ejecting head.

19. The liquid ejecting head according to claim 3, further comprising:

a plurality of individual outlet flow paths that individually allows communication from the pressure chambers to the second common flow path, wherein the second compliance portion does not overlap the plurality of individual outlet flow paths when viewed in a thickness direction of the second compliance portion.

* * * * *